US005782406A

United States Patent [19]

Igwemezie

[11] Patent Number: 5,782,406

[45] Date of Patent: Jul. 21, 1998

[54] RAIL TIE PLATE CLIPS AND SHOULDERS

[76] Inventor: Jude O. Igwemezie, 1020 Denison Street, Suite 207, Markham, Ontario, Canada, L3R 3W5

[21] Appl. No.: 566,327

[22] Filed: Dec. 1, 1995

Related U.S. Application Data

[63] Continuation-in-part of Ser. No. 139,736, Oct. 22, 1993, abandoned.

[30] Foreign Application Priority Data

| | | | |
|---|---|---|---|
| Jun. 2, 1993 | [GB] | United Kingdom | 9311395 |
| Jan. 13, 1995 | [GB] | United Kingdom | 9500700 |

[51] Int. Cl.[6] ..... E01B 3/00

[52] U.S. Cl. ..... 238/67

[58] Field of Search ..... 238/67, 68, 297, 238/287, 310, 315, 321, 349, 351, 348

[56] References Cited

U.S. PATENT DOCUMENTS

| | | | |
|---|---|---|---|
| 473,934 | 5/1892 | Knox | 238/68 |
| 477,112 | 6/1892 | Graeber | 238/68 |
| 592,907 | 11/1897 | Gilpin | 238/68 |
| 816,575 | 4/1906 | Gardin . | |
| 834,682 | 10/1906 | Rhodes | 238/68 |
| 871,658 | 11/1907 | Wright | 238/68 |
| 883,562 | 3/1908 | Nichols | 238/68 |
| 1,054,553 | 2/1913 | Hoyt . | |
| 1,070,103 | 8/1913 | Berrien . | |
| 1,181,693 | 5/1916 | Stults . | |
| 1,745,763 | 2/1930 | Iida . | |
| 1,888,618 | 11/1932 | Woodings . | |
| 1,925,124 | 9/1933 | Warr . | |
| 2,385,032 | 12/1945 | Scholes . | |
| 2,533,055 | 12/1950 | Schulze . | |
| 2,535,337 | 12/1950 | Wertz . | |
| 3,062,450 | 11/1962 | Hanff . | |
| 4,074,860 | 2/1978 | Rex . | |
| 4,328,547 | 5/1982 | Phillips . | |
| 4,373,667 | 2/1983 | Duchemin . | |
| 4,967,954 | 11/1990 | von Lange | 238/351 |

FOREIGN PATENT DOCUMENTS

| | | |
|---|---|---|
| A-73638/74 | 1/1976 | Australia . |
| B 555 589 | 10/1986 | Australia . |
| A 384 129 | 12/1931 | Belgium . |

(List continued on next page.)

OTHER PUBLICATIONS

Allevard Stedef "Stedef DSA Fastening", 2 pages, no date.

BHP Rail Products (Canada) Ltd. "Steel Ties and Turnouts", 4 page, no date.

Sato Railway Systems "Y-shaped steel sleeper track for railways", 11 pages, no date.

Pandrol Incorporated "Tie Plate", 2 pages, no date.

General & Railway Suoolies Pty. Ltd. "Rex-Lok-In Rail Fastening System", 6 pages, no date.

*Primary Examiner*—Mark T. Le

*Attorney, Agent, or Firm*—Ridout & Maybee

[57] ABSTRACT

A steel tie for incorporation in rail track has a horizontal rectangular plate for connection transversely of the rail to restrain vertical rail movement. The longer sides of the horizontal plate terminate in downwardly and outwardly inclined margin portions for capturing ballast. A web member extends vertically on the underside of the plate member and parallel to and centrally of the longer sides of the plate and serves to restrain longitudinal rail movement. Curved ballast engaging plate members are connected on the underside of the tie to provide lateral stability. The plate members are detachable and replaceable with smaller or larger members to provide a smaller or greater ballast engaging area. The lower edge of the vertical web has a thickened portion to carry stresses. Rail fastening devices consist of a pair of opposing longitudinally extending shoulders adapted to accommodate the rail flange between them. Each shoulder has a downwardly facing abutment surface, and a resilient rail clip has an intermediate portion that bears upwardly on the abutment surface, an end portion that extends inwardly from the abutment surface and bears resiliently on the upper side of the rail flange.

44 Claims, 39 Drawing Sheets

FOREIGN PATENT DOCUMENTS

| | | | |
|---|---|---|---|
| A 0 161 786 | 11/1985 | European Pat. Off. . | |
| A 0 162 406 | 11/1985 | European Pat. Off. . | |
| A 0 298 904 | 1/1989 | European Pat. Off. . | |
| A 393 023 | 12/0000 | France . | |
| A 492 610 | 7/1919 | France . | |
| 1064956 | 5/1954 | France . | |
| A 1 326 483 | 4/1963 | France . | |
| A 2 561 274 | 9/1985 | France . | |
| A 2 623 827 | 6/1989 | France . | |
| C 88 898 | 10/1896 | Germany . | |
| 0105110 | 4/1898 | Germany . | |
| 0228433 | 5/1907 | Germany . | |
| C 191 857 | 11/1907 | Germany . | |
| C 820 010 | 5/1952 | Germany . | |
| B 10 88 524 | 9/1960 | Germany . | |
| B 11 88 637 | 3/1965 | Germany . | |
| A 21 01 434 | 7/1971 | Germany . | |
| 6030 | 9/1887 | United Kingdom | 238/67 |
| 18523 | 9/1900 | United Kingdom | 238/67 |
| 281544 | 12/1927 | United Kingdom . | |
| 330722 | 6/1930 | United Kingdom . | |
| 598515 | 2/1948 | United Kingdom . | |
| 366302 | 2/1962 | United Kingdom . | |
| 1336862 | 11/1973 | United Kingdom . | |
| 2 131 472 | 6/1984 | United Kingdom . | |
| 2 142 068 | 1/1985 | United Kingdom . | |
| A 93 12296 | 6/1993 | WIPO . | |
| A 94 28245 | 12/1994 | WIPO . | |

RAIL TIE PLATE CLIPS AND SHOULDERS

This application is a continuation-in-part of application PCT/CA94/00303 filed Jun. 2, 1994 which is a continuation-in-part of application Ser. No. 08/139,736 filed Oct. 22, 1993 (abandoned).

The present invention relates to ties, tie plates, clips and shoulders for incorporation in a rail track. These elements may preferably and advantageously be used in combination, but may be used independently.

In a first aspect, the invention provides a steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement.

An end or ends of the plate member may be bent downwardly to provide restraint against lateral tie movement, or, in a preferred form, at least one ballast engaging plate member may be connected to the tie on its underside and facing generally transversely of the rail for restraining lateral tie movement.

With the preferred form of tie of the invention, the elements that provide vertical, longitudinal and lateral restraint respectively have in effect been separated into three distinct elements each of which can be designed substantially independently of the others to provide the required motion restraint and other characteristics. The tie is well adapted to distribute stress and mitigate stress concentrations. A further advantage is that the structure of the tie lends itself readily to conventional stress analysis techniques, for example finite element stress analysis so that the elements and the structure as a whole can be engineered to provide for satisfactory stress management.

With the tie of the invention, the horizontal plate member bears on the ballast and can serve to provide sufficient bearing area to maintain ballast stresses at desired low levels. The tie may be used with a reduced depth of ballast as compared with known ties, since the horizontal plate member is at the upper end of the tie structure. The web structure can serve to ensure adequate shear stiffness for the tie. Preferably, the web structure comprises one or more webs the lower edge or edges of which is or are thickened or bulbous, since it has been found that this reduces stress concentrations in the tie. The bent over end or ends of the plate member, or the ballast engaging plate member or members provide restraint against lateral buckling of the track under compressive or thermal forces, centripetal train forces on curves or combinations of these. In the preferred form, the ballast engaging plate member or members are concave on a side facing transversely of the rail to provide increased lateral strength, and have a portion or portions passing upwardly through an opening in the horizontal plate member and are located relative to the plate member, for example by bending or twisting the end portions or by using cotter pins or like pins passed through holes in the portions upstanding above the horizontal plate member. A portion of the ballast engaging plate member or members is preferably seated in and located in a notch in a lower edge of a web member. This preferred arrangement provides a simple and highly effective connection between the ballast engaging plate member or members and the tie. The tie may have a ballast engaging plate member adjacent each end and, if the end plate members do not provide sufficient lateral restraint in a given application an intermediate plate may be provided at a point the preferred location of which may desirably be determined with the aid of stress analysis.

In a further aspect, the invention provides a rail fastening device comprising a pair of opposing longitudinally extending shoulders adapted to accommodate a rail flange therebetween, a downwardly facing abutment surface provided on each shoulder, and a resilient rail clip having an intermediate portion bearing upwardly on said abutment surface, an end portion extending inwardly from said abutment surface and adapted to bear resiliently on an upper side of the flange for restraining the rail against vertical movement, and an outer portion extending outwardly from said abutment surface and curving laterally arcuately outwardly and downwardly toward a lower portion adapted to bear on a bearing surface at a region offset laterally inwardly from a centre of curvature of said outer portion.

This arrangement provides better distribution of stress through the rail clip than known devices of which applicant is aware, and avoid concentrations of stress that may result in failure of the rail fastening device in service. When the above clip in service resists a tendency for the rail flange to lift upwardly, for example to prevent rail roll over, there is a reversal of stress, and hence a point of zero stress in the outer portion between the abutment surface and the lower portions bearing on the bearing surface, and this results in good stress distribution. Having the bearing portion offset laterally inwardly from a centre of curvature of the outer portion results in the clip having increased compliancy, so that installation of the clip is facilitated, and further improves the stress distribution.

In a further aspect, the invention provides a rail retaining device comprising shoulder members for engaging opposite lateral sides of a rail flange, and a rail clip associated with each shoulder member in the form of a bent rod symmetrical about a vertical plane extending laterally of the rail and having an inner portion bearing on the adjacent flange, intermediate limb portions bearing upwardly on a downwardly facing abutment surface provided on the shoulder member and outer portions reacting resiliently on a bearing surface and each comprising a coil spring having a substantial portion thereof extending in a second vertical plane.

The rail clip of this device has the advantage that it is tolerant of dimensional variations in the rail or rail flange, in the shoulder member and in the clip itself, for example arising from manufacturing tolerances, as well as of variations in elevations of the rail flange for example as a result of canting of the rail. The coil spring renders the clip highly compliant. As compared with known bent rod clips of which applicant is aware, the device of the invention greatly reduces the torsional stresses to which the rod is subjected in installation or service.

In a further aspect, the invention provides a rail fastening apparatus comprising a shoulder member engaging at least one side of the rail flange and receiving a rail clip in the form of a resilient rod bent to provide in the installed position limb portions extending transversely of the rail and inner and outer portions adapted to bear on the rail flange and on a bearing surface laterally outwardly of the rail, respectively, said bent rod being generally symmetrical about a vertical plane transverse of the rail, said limb portions comprising an upper pair and a lower pair, and said shoulder member having a reaction surface engaging one of said pairs of limb portions when displaced relative to the shoulder member as a result of upward pressure exerted by said rail flange and displacing said one pair into contact with the other pair to provide a load bearing cross section of increased depth providing increased strength and bending stiffness.

This arrangement allows the rail clip to be formed of relatively thin rod, whereby the clip is made tolerant of dimensional variations, compliant, and relatively easy to install and lightweight and inexpensive to ship. When one pair of the limb portions is displaced into contact with the other, greatly increased strength and resistance to bending is achieved, since the limb portions effectively provide a beam of increased depth of cross-section. As is in itself known, the strength of a beam and its bending stiffness are related to the cube power of the depth of the beam.

In a still further aspect, the invention provides a rail tie plate suitable for attachment to a wood tie, comprising a base plate adapted to be applied to the tie and a pair of abutment members upstanding therefrom to accommodate a rail therebetween and each providing a downwardly facing upper abutment surface for reaction with a laterally inwardly inserted rail clip, and an upwardly facing lower ramp surface inclining from a laterally outer side of each abutment member upwardly inwardly to a laterally inner side thereof for facilitating insertion of the clip to an installed position wherein an inner end of the clip bears resiliently on an inner side of the rail flange.

Whereas known wood tie plates of which applicant is aware have offered difficulties to insertion of rail clips, the ramp surfaces of the above plate facilitate insertion of the rail clip, such as a rail clip as described above, inwardly to an installed position wherein the inner end of the clip bears on a rail flange disposed between the abutment members.

In a further aspect, the invention provides a hook-in shoulder for fastening a rail relative to a horizontal plate member of a tie comprising a shoulder member for bearing toward a rail flange and having a pair of hook-in legs for passing through complimentary apertures in the horizontal plate member of the tie and engaging with the lower side of the horizontal plate member, each shoulder member having an abutment portion upstanding therefrom having an opening therethrough providing a downwardly facing abutment surface for reaction with a rail clip, wherein said abutment portion is box-form and said opening therethrough is bounded by a continuous upper wall providing said downwardly facing abutment surface.

The box form abutment portions offer considerably improved resistance to derailed dragging equipment as compared with known hook-in shoulder members of which applicant is aware.

In a further aspect, the invention provides a hook-in shoulder for fastening a rail relative to a horizontal plate member of a tie comprising a shoulder member for bearing toward a rail flange and having a pair of hook-in legs for passing through complimentary apertures in the horizontal plate member of the tie and engaging with the lower side of the horizontal plate member, each shoulder member having an abutment portion upstanding therefrom having an opening therethrough providing a downwardly facing abutment surface for reaction with a rail clip, and an integral seating portion extending laterally outwardly from the abutment portion and having a lower side bearing on the plate member and an upper side formed with a pit for locating a rail clip.

These shoulders provide a seat for rail clips, such as clips as described above, and facilitate installation and retention of such clips.

The above noted aspects of the invention are described in more detail hereinafter, by way of example, with reference to the accompanying drawings.

Figure 1:
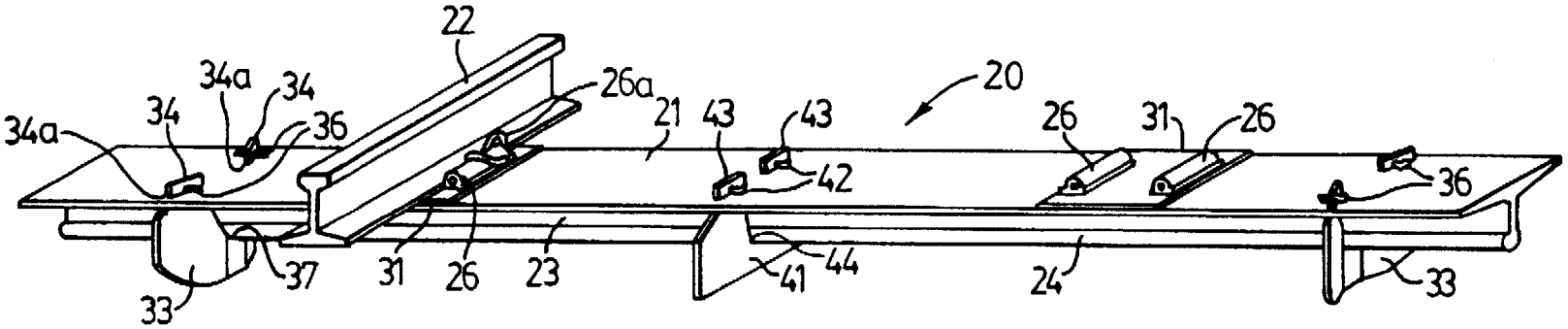
FIG. 1 is an isometric view of a first form of tie in accordance with the invention together with means for fastening rails thereto.
Figures 2, 3, 4, 5:
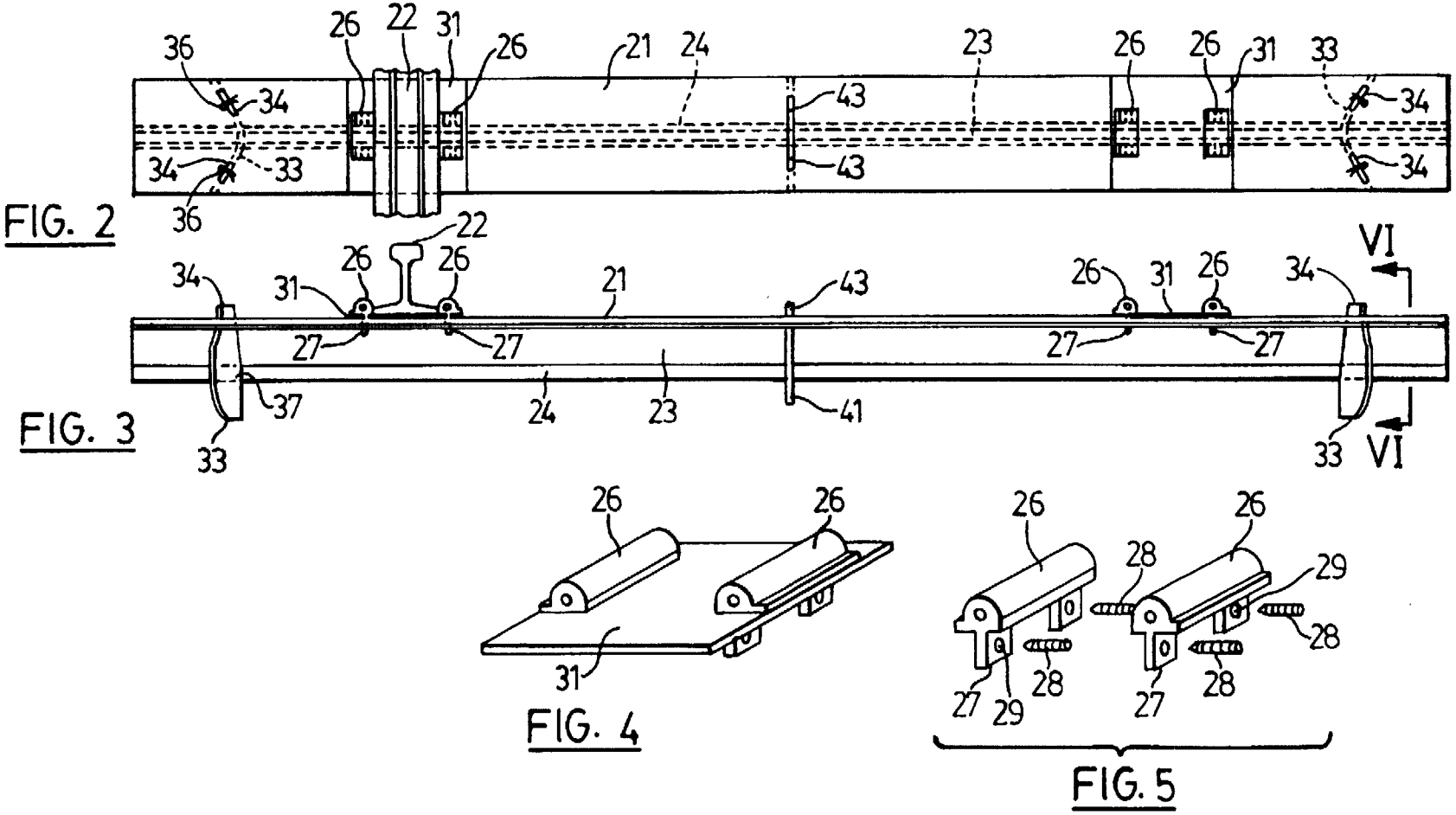
FIGS. 2 and 3 are plan and side views, respectively of the tie of FIG. 1.
FIG. 4 is an isometric view showing rail fastening means employed with the tie of FIGS. 1 to 3.
FIG. 5 shows the shoulder portions and locking pins for the fastening means of FIG. 4.
Figure 6:
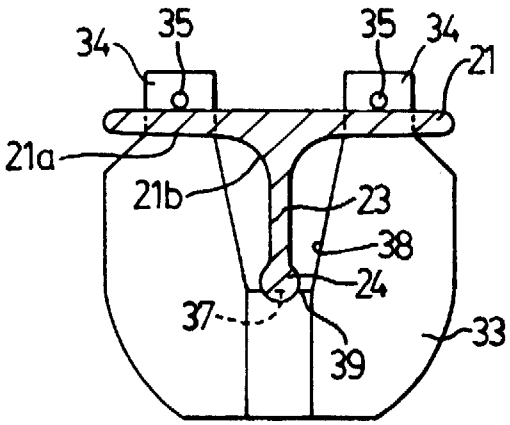
FIG. 6 shows a cross-section on an enlarged scale taken on the line VI—VI in FIG. 3.
Figure 7:
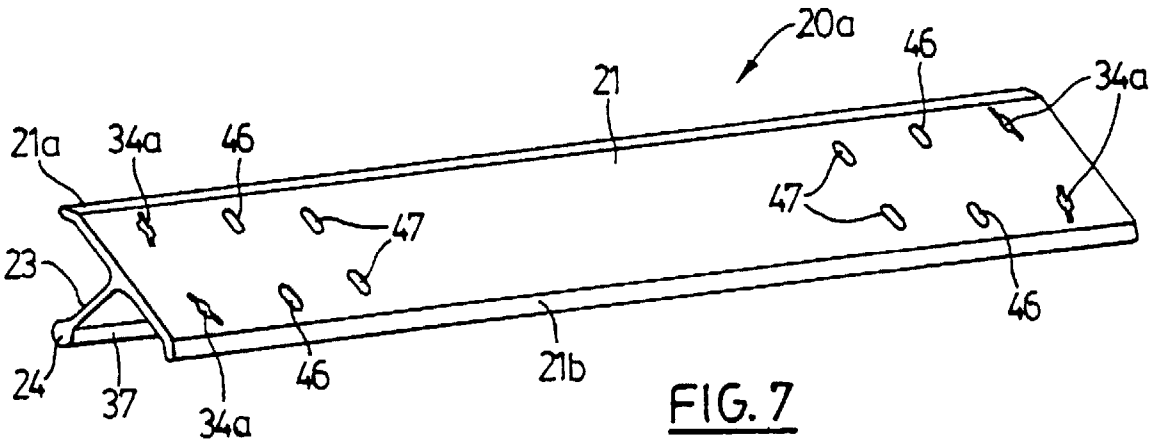
FIG. 7 is an isometric view of a second form of tie in accordance with the invention.

Referring to the drawings, wherein like reference numerals indicate like parts, FIGS. 1 to 6 show a steel tie 20 comprising a generally horizontal oblong rectangular plate member 21 which is for connection transversely of the rails of which a short section of one rail is indicated at 22 in FIGS. 1 and 2. In FIG. 1, as well as in subsequent Figures, rails 22 and the like are shown as only short lengths for clarity of illustration, whereas it will be appreciated that, in installed track, lengths of rails 22 and the like run continuously over successive ties 20 and the like which are disposed at the usual intervals along the track. Web structure extends generally vertically on the underside of the plate member 21, comprising a web member 23 extending substantially centrally between the longer sides of the plate member 21. Preferably, in order to alleviate strains to which the tie is subjected in use, the plate member 21 increases in thickness from each longer edge inwardly toward the web member 23. For example, in one preferred form, the lower side 21*a* of the member 21 slopes inwardly downwardly at an angle of about 2°. The lower side of the member 21 joins with the web member 23 through a smooth arcuate transition portion 21*b*. Preferably, in order to reduce stresses to which the tie is subjected in use, the lower edge of the web member 23 is formed with a thickened or bulbous portion 24, the edges of which merge smoothly with the sides of the web member 23, as best seen in FIG. 7.

In the preferred form of tie shown in the drawings, the horizontal member 21 provides sufficient bearing area to minimize ballast stress. The web member 23 ensures adequate shear stiffness whereas the bulbous portion 24 at the base of the web member 23 carries tensile and compressive stresses arising from bending of the tie.

To fasten the rails such as rail 22 to the ties, shoulder members 26 are provided. The shoulder members 26 hold the rail 22 with the aid of conventional clip members, for example Universal Pandrol clips 26*a* as shown. As will be appreciated, however, the structure of the invention is adapted to cooperate with various forms of rail fastening devices. In the example shown in FIGS. 1 to 6, a pair of the shoulder members is employed on each side of each rail 22. Each shoulder member 26 has two leg portions that extend through slots formed in the horizontal plate member 21. The leg members 27 anchor beneath the plate member 21 through application of locking pins 28 inserted through openings 29 in each leg member 27. In the preferred form, to provide for desired inward cant of the rails 22, cant plates 31 are employed between the shoulder members 26 and the upper side of the horizontal plate member 21. The plates 31 are provided with slots to receive the leg members 27. It may be noted that cant plates 31 of any desired degree of tilt may be incorporated into the fastening means. For example, some railroads use 1:20 cant plates and others 1:40 cant plates. The tie according to the present invention does not need to be specially deformed to provide for either type of rail seat cant. The cant plates 31 which are sandwiched between the rails 22 and the plate member 21 also serve as sacrificial wear plates that are considerably easier and substantially less expensive to replace than an entire tie.

The tie 20 may be provided with at least one ballast engaging plate member such as a member 33 connected to the tie on its underside and facing generally transversely of the rail 22 for restraining lateral tie movements. To provide for added lateral strength, the plates 33 are preferably curved, to provide a concavity on a side facing transversely of the rail 22. Each plate member 33 is connected to the tie 20 through a three point securement. The upper end of each plate member 33 is provided with a pair of upwardly extending end portions 34 passing through slots 34*a* formed symmetrically of the medium of the plate member 21 that extends transversely of the rail, for transferring lateral forces between the portions 34 and the plate member 21. The slots are, accordingly, preferably formed symmetrically on each side of the web member 23. Cotter pins 36 or like retaining pins may be passed through holes 35 in the upper end portions 34 to locate the plate members at each of two upper points adjacent the upper side of the plate member 21. Alternatively, the end portions 34 extending above the plate member 21 may be bent over or twisted to locate them relative to the plate member 21. The third retaining point for each plate member 33 is provided in the examples shown in FIGS. 1 to 6 by a notch 37 formed in the lower side of the bulbous portion 24 of the web member 23. Each plate member 33 is formed with a slot in its upper side, as seen in FIG. 7, through which the web member 23 extends. A portion 39 of the plate member adjacent the lower end of the slot 38 lodges in the notch 37.

The plates 33 are preferably connected in the ends of the tie 20 at areas where the stresses applied are very low. A further advantage of the present design is that the size of the plates 33 can be increased or decreased at will by substituting differently sized plates for the plates 33 in order to provide greater or smaller ballast-engaging area or to match the required lateral track stability in a given application.

Alternatively, instead of providing separate plates 33, an end or both ends of the plate member 21 may be bent over downwardly to provide restraint against lateral movement. In such case, the end portion or portions of the web member 23 are cut away, and the end or ends of the plate member bent down preferably to abut against the cut ends of the web member 23.

Where the lateral stability provided by the end plates 33 is not sufficient, one or more intermediate ballast-engaging plates 41 may be located in the middle span of the tie 20 to provide extra lateral strength to the tie 20 and to brace the web member 23 against transverse buckling. The exact location of the intermediate plate or plates 41 to avoid undesired stress concentrations may be determined by conventional stress analysis methods. In the example shown, the intermediate plate member 41 is, similarly to the plate members 33, retained by a three point securement wherein upper end portions 43 of the plate member 41 upstanding through slots formed through the horizontal plate member 21 are secured on either side of the web 23, for example by being bent over or twisted or through the use of cotter pins 42 passed through holes in the portions 43, and a lower portion of the plate 41 is located in a notch 44 formed in the bulbous portion 24 at the bottom edge of the web 23.

FIG. 7 shows a modified and preferred form of tie 20*a* wherein the plate member 21 is generally of uniform thickness and has outer margin portions 21*a* and 21*b* on each longer side that are inclined downwardly outwardly relative to the horizontal plate portion 21. The portions 21*a* and 21*b* serve to capture ballast beneath the plate member 21 and resist any tendency for the tie to sink downwardly into the gravel or other ballast under the tie 20*a*. In this example, the slots 34*a* for reception of the upper end portions of the ballast engaging members are inclined oppositely from the openings of the embodiment of FIGS. 1 to 6, that is to say, in the direction outwardly from the web structure 23 they incline transversely inwardly toward the centre of the tie 20*a*, to locate ballast engaging plate members 33 having their concave side directed transversely inwardly toward the centre of the tie 20*a*, as seen in FIG. 8, so as to tend to retain ballast beneath the tie 20*a*.

Figure 8:
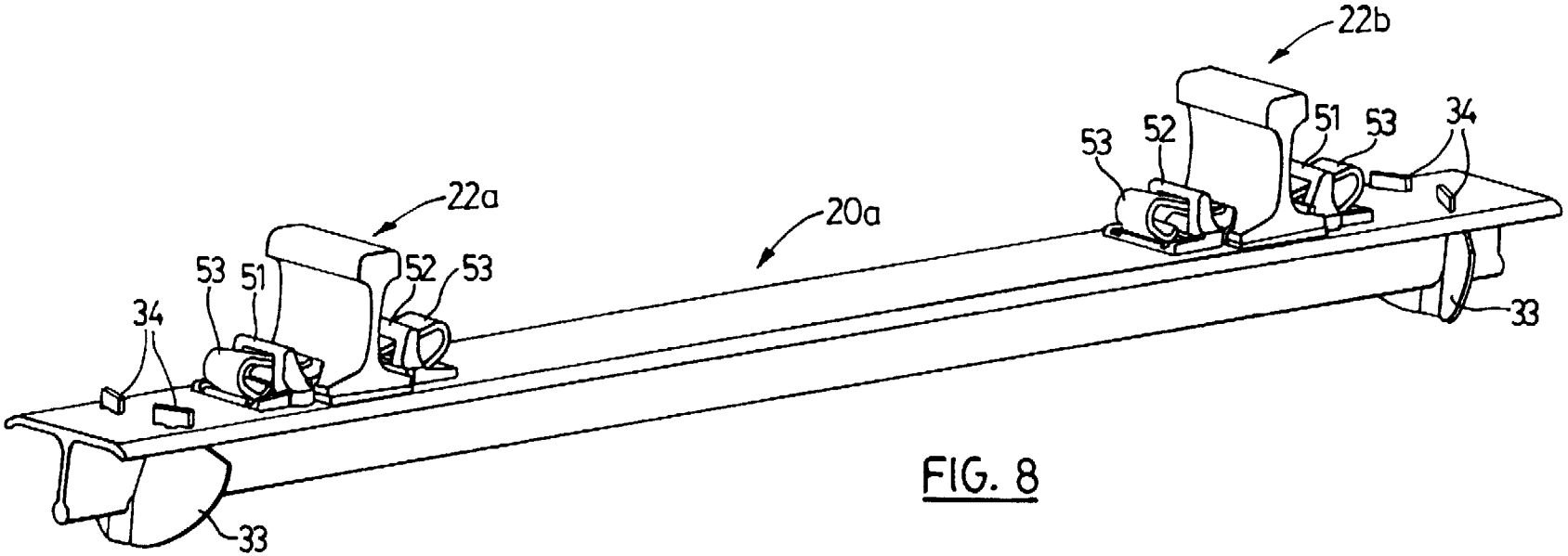
FIG. 8 is an isometric view of a rail fastening arrangement in accordance with the invention comprising the tie of FIG. 7.

It may be noted from FIGS. 7 and 8 that the plate member 21 is formed, on each side of the rails 22*a* and 22*b* with apertures 46 and 47 that are asymmetric about the longitudinal median of the rail. For example, as seen in FIG. 7, apertures 46 on the laterally outer side of the rail are spaced apart a distance greater than the spacing of the apertures 47 on the inner side of the rail, so that apparatus fastened to openings 46 is non-interchangeable with apparatus fastened to openings 47, for reasons discussed later.

Figure 9:
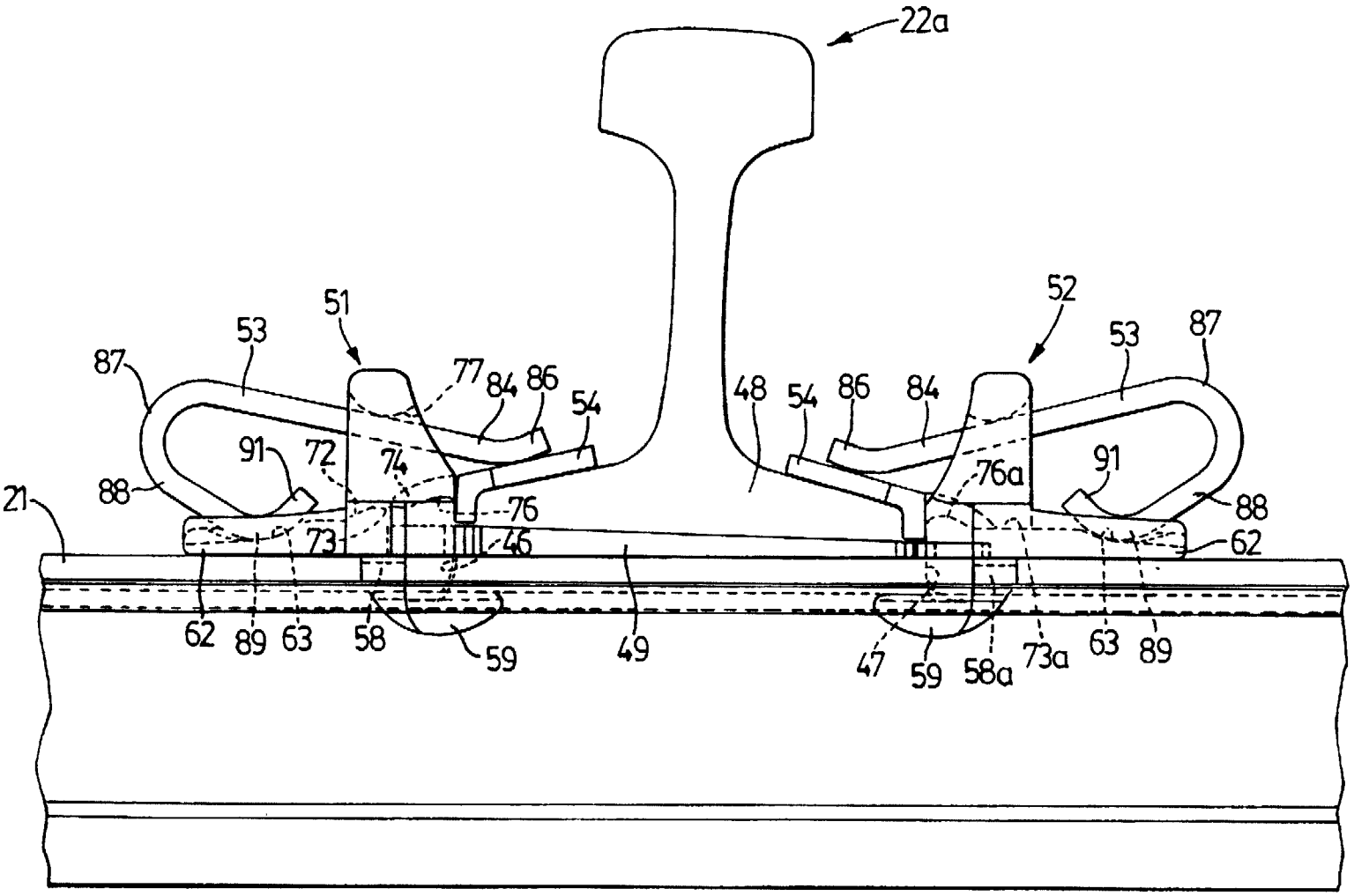
FIG. 9 is a side view on an enlarged scale of a rail fastening device shown in of FIG. 8 with internal structure shown in broken lines.
Figure 10:
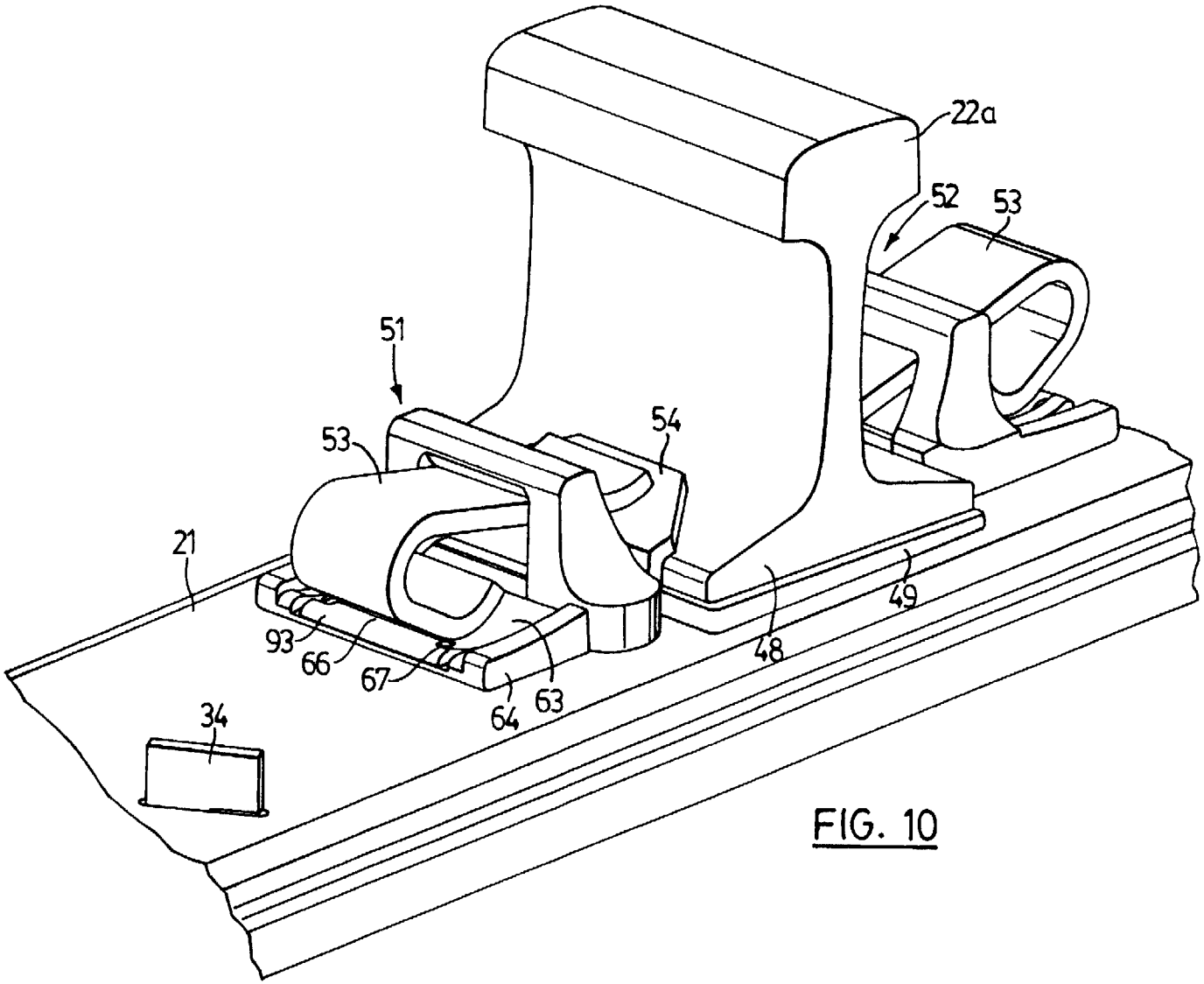
FIG. 10 is an isometric view of the rail fastening device of FIG. 9.

In the rail fastening arrangement shown in FIGS. 8, 9 and 10, the rails 22*a* and 22*b* are canted inwardly downwardly. As seen, for example in FIG. 9, the flange 48 of rail 22*a* is seated on a tapering cant plate 49 interposed between the plate member 21 and the flange 48.

The flange 48 is located between hook-in shoulder members 51 and 52 and retained by clips 53 inserted through the shoulder members 51 and 52 and bearing downwardly toward the rail flange 48. In the example illustrated, insulators 54 are interposed between the clips 53 and flange 48, but it will be appreciated that a similar arrangement may also be employed without the insulators 54 wherein clips 53 or the like bear directly on the flange 48.

Figure 11:
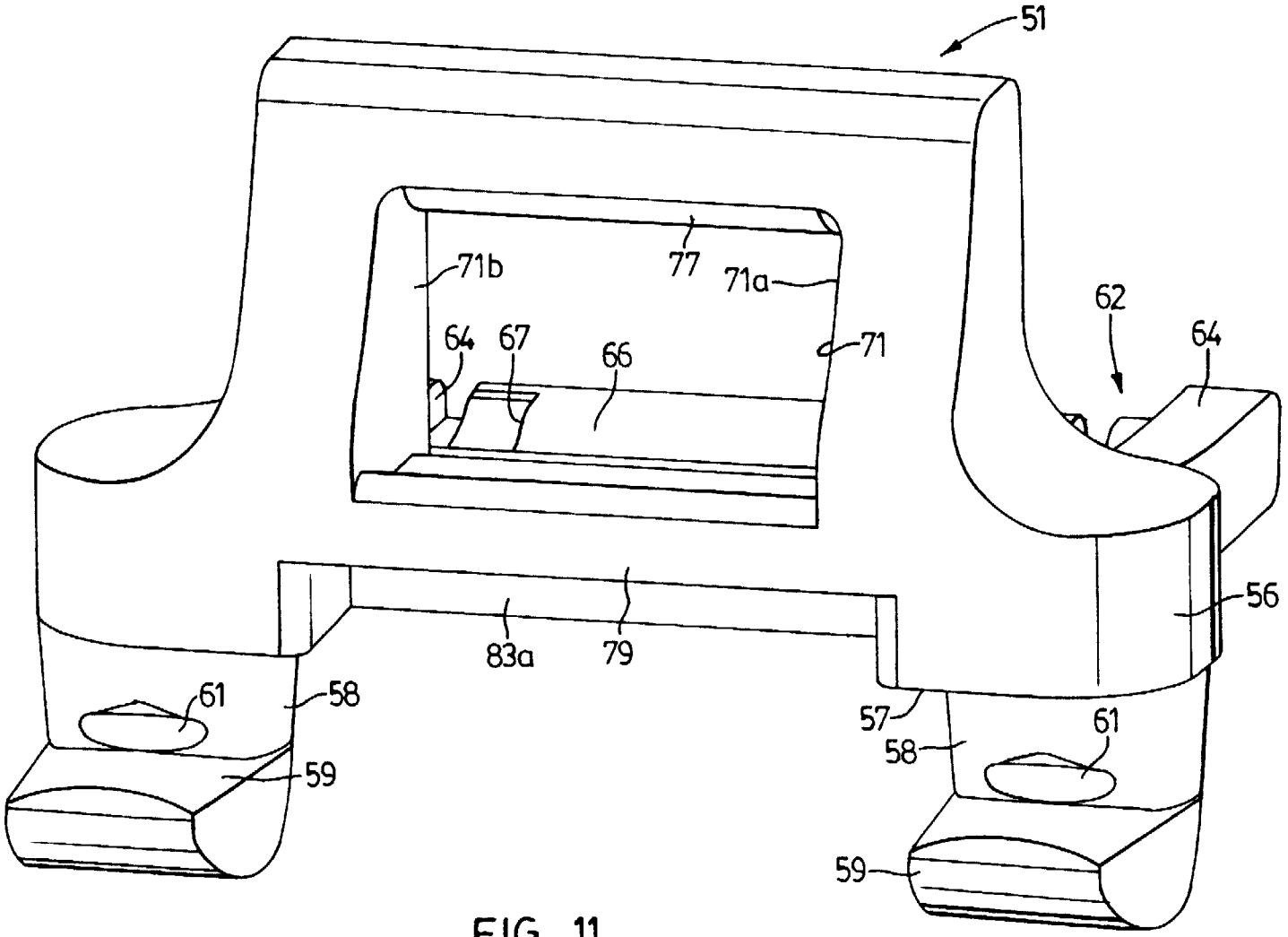
FIG. 11 is an isometric view from one side of a hook-in shoulder employed in the arrangement of FIGS. 8 to 10.
Figure 12:
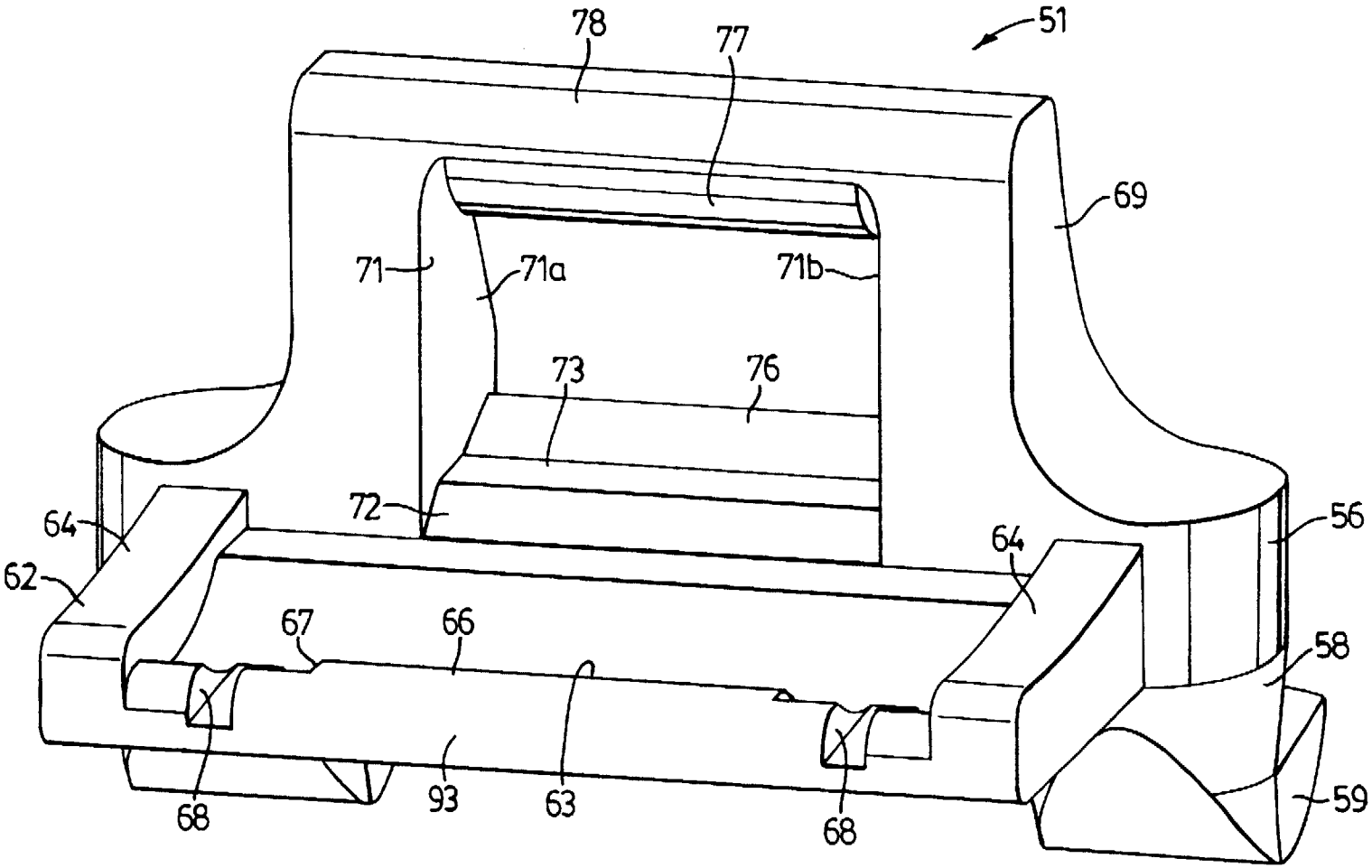
FIG. 12 is a view from the opposite side of the shoulder of FIG. 11.
Figure 13:
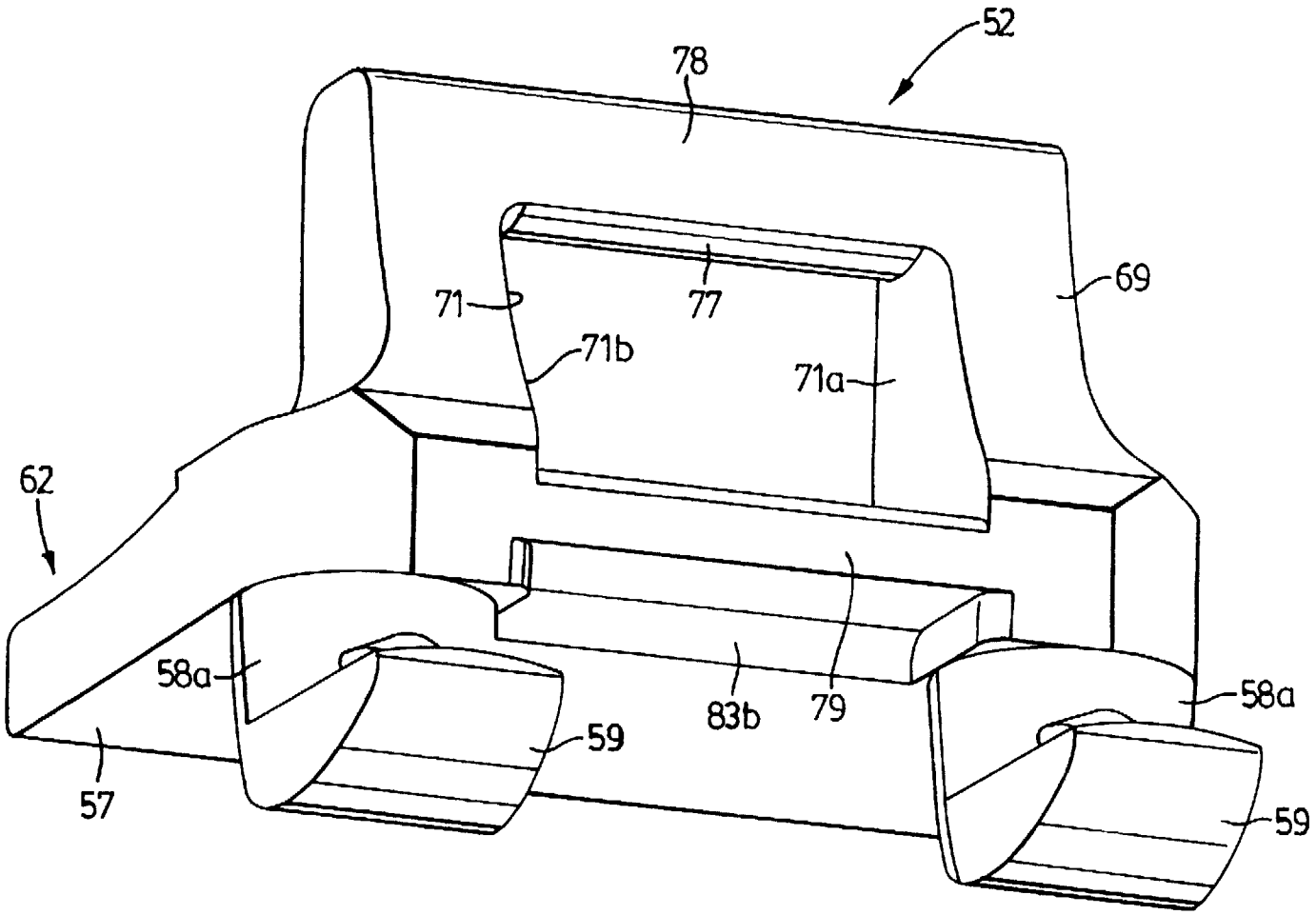
FIG. 13 is an isometric view from one side of another shoulder employed in the arrangement of FIGS. 8 to 10.
Figure 14:
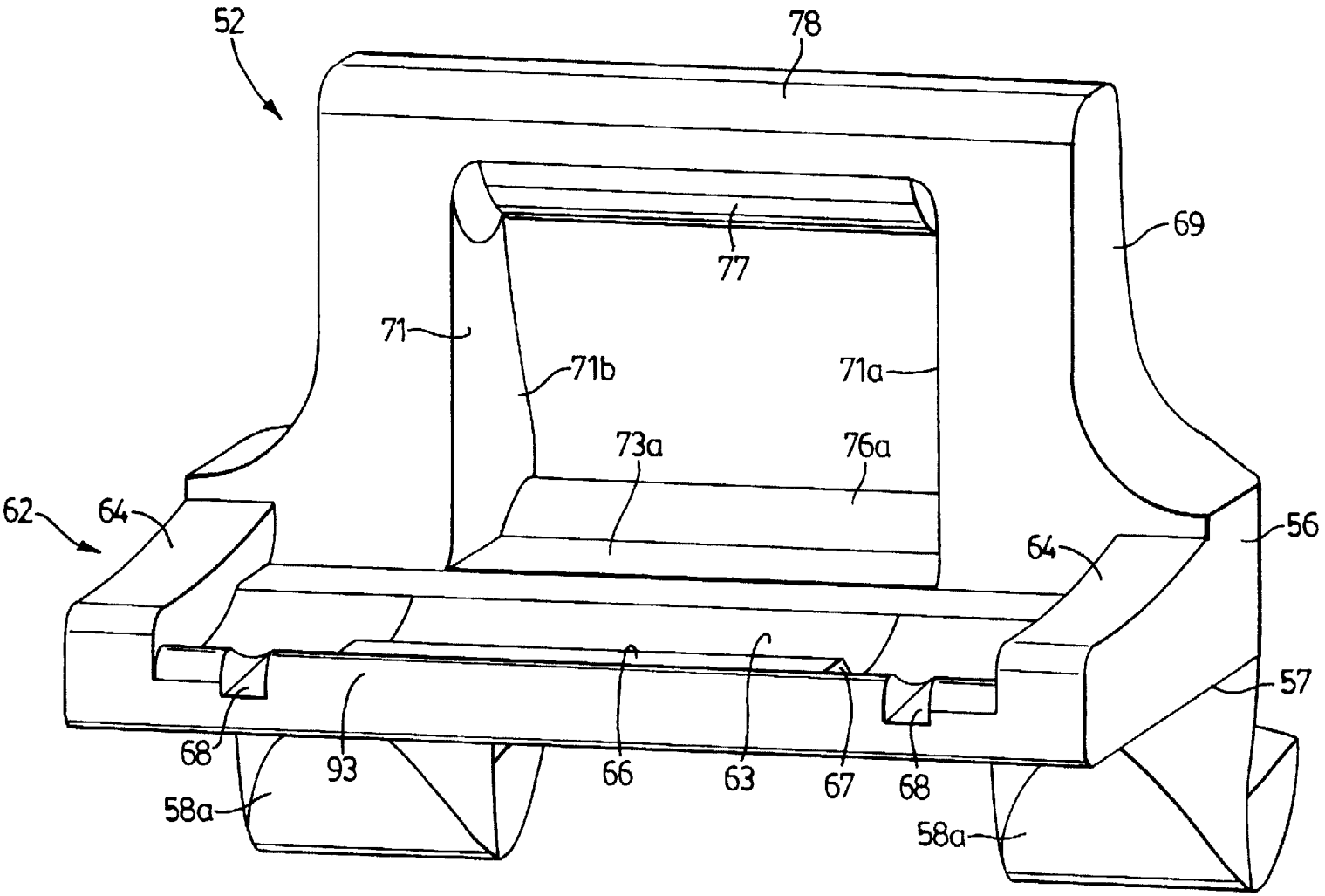
FIG. 14 is a view from an opposite side of a shoulder of FIG. 13.
Figure 16:
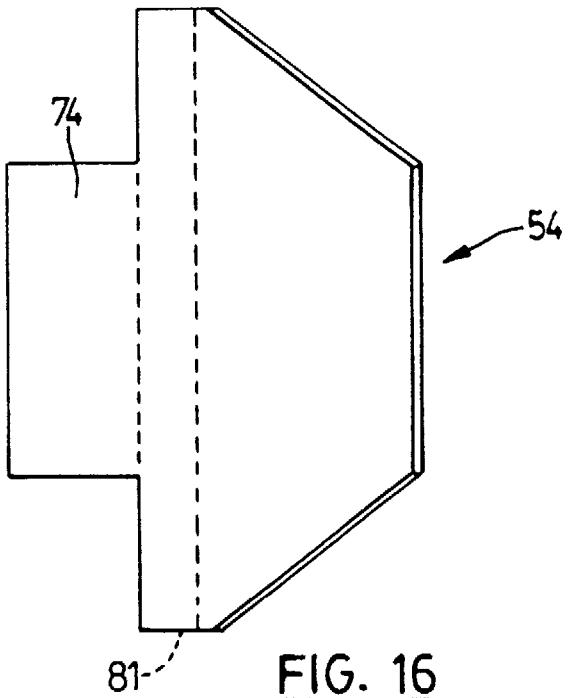
FIGS. 15, 16, 17 and 18 are isometric, plan, side view and front views of an insulator employed in the rail fastening arrangement of FIGS. 8 to 10.
Figure 18:
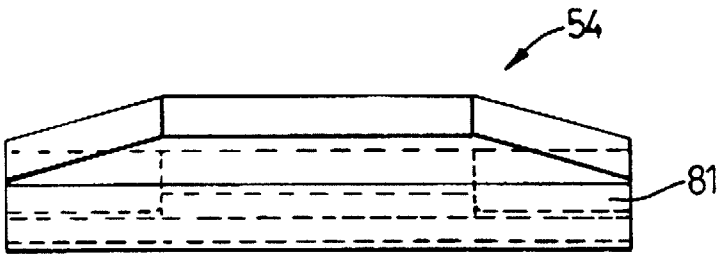
Figure 15:
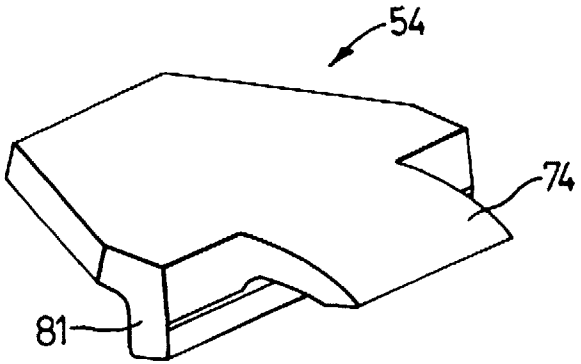

FIGS. 11 and 12 shown in more detail the shoulder member 51 comprising a base 56 having a planar lower surface 57 for seating on the plate member 21, and a pair of legs 58 with lateral extensions 59 adapted to be inserted through the openings 46 and to engage the lower side of the plate member 21, as seen in FIG. 9. As seen in FIG. 11, the inwardly facing sides of the legs 58 may be provided with recesses 61 to assist in clearing the edges of the openings 46 during insertion. Laterally outwardly, the base 56 is formed with an extension or seating portion 62 having its lower surface coplanar with the surface 57 and a longitudinally elongated trough-like recess or pit 63 in the upper side for receiving rail clips such as the clip 53 or the like. The pit 63 in this example is generally concave in lateral cross-section, as seen in FIG. 9, and at each end of the trough-like pit 63, the extension is provided with upstanding laterally extending anti-squat walls 64 adapted for confining the limb portions of rod-form clips, as described in more detail later. An outer side of the trough-like pit 63 may be formed with an inwardly directed portion 66, the longitudinally directed end faces of which 67 may act as further longitudinal restraints for rod form clips or the like. Drainage channels 68 extend from the trough-like pit 63 to the outer side of the seating portion 62.

Upstanding from the base 56 is a box-like abutment portion 69 having an opening 71 therethrough to receive the clips 53 or the like. The lower side of the opening 71 comprises an upwardly inwardly inclining ramp surface 72, a generally horizontal portion 73 which may receive an outer end 74 and a laterally inwardly disposed outwardly inclining ramp surface 76. In the event the clips 53 and shoulders 51 and 52 are employed in the absence of the insulators 54, the ramp surfaces 72 and 76 serve to facilitate inward insertion of the clips 53 to the installed position as seen in FIGS. 9 and 10 wherein the inner ends of the clips bear downwardly on the rail flange 48. Further, with the insulators installed, as seen in FIG. 9 the surface 76 supports the correspondingly inclined ramp-like portion 74 of the insulator 54 which facilitates installation of the clips 53.

The upper side of the opening 71 comprises a downwardly convex abutment surface 77. It will be noted that the opening 71 is bounded by a continuous upper wall comprising a cross bar portion 78 the lower side of which provides the downwardly facing abutment surface 77. The box form abutment portion 69 with its continuous upper wall 78 provides considerably improved resistance to fracture or deformation of the shoulder portion when exposed to derailed dragging equipment.

The other shoulder portion 52 on the lower side of the rail flange 48 is generally similar to the shoulder described above with reference to FIGS. 11 and 12, except the opening 71 is disposed at a lower elevation relative to the planar lower side 57 and comprises a generally planar portion 73*a* for reception of the end 74 of the insulator 54 thereon and an upwardly inwardly inclining ramp portion 76*a*. The legs 58*a* of the shoulder portion 52 are spaced a smaller distance apart, corresponding to the spacing of the openings 47, while legs 58 of the shoulder of FIGS. 11 and 12 have a spacing corresponding to the openings 46, so that the shoulders 51 and 52 are non-interchangeable, and inner shoulder 53 designed to be applied to the lower side of the canted rail flange 48 cannot inadvertently be installed on the outer or upper canted side of the flange or vice versa.

An inner, preferably generally vertical face 79 of the shoulders 51 and 52 bears directly on and locates the edges of the rail flange 48 or bears toward such edges and locates them with the interposition of a wall portion 81 of the insulator shown in more detail in FIGS. 15 to 18. In the case in which the faces 79 bear directly on the edges of the flange 48, the tie 20 or 20*a* is formed with a somewhat smaller spacing than illustrated between the sets of openings 46 and 47.

Figure 20:
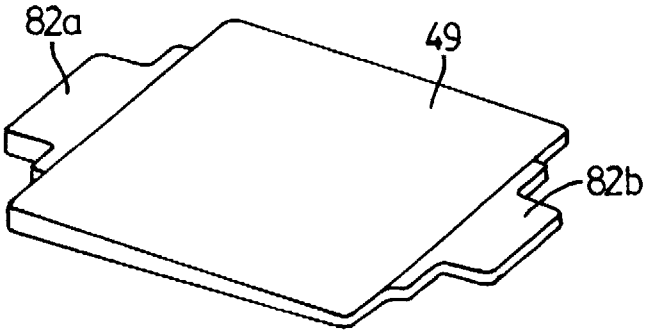
FIGS. 19, 20 and 21 are plan, isometric and side views of an insulating cant or seat plate used in the fastening arrangement of FIGS. 8 to 10.
Figure 19:
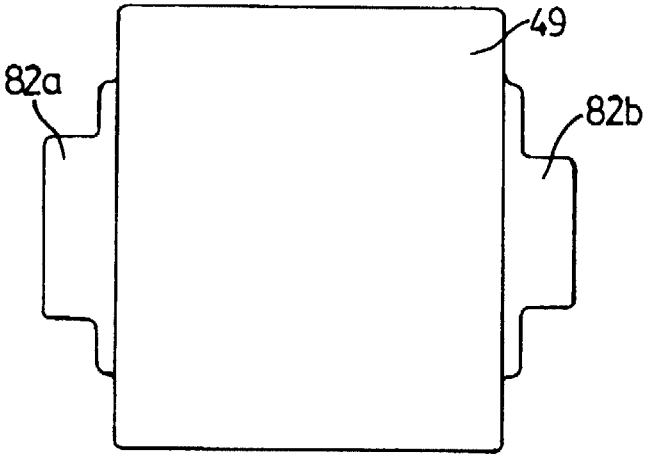
Figure 21:
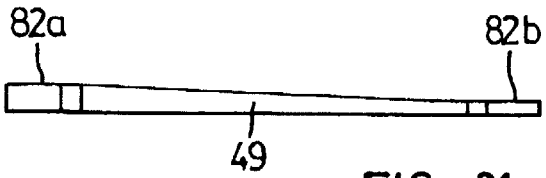

In the preferred form, the tie plate or pad 49 shown in more detail in FIGS. 19 to 21 is a resilient insulating pad as described in applicant's U.S. Pat. No. 5,335,850, issued Aug. 9, 1994, the disclosures of which are incorporated herein by reference.

The pad is formed with tabs 82*a* and 82*b* which are of different lengths and are received snugly in complimentary pockets 83*a* and 83*b* in the shoulder members 51 and 52, respectively, so that the pad 49 cannot inadvertently be installed wrongly and the rail inadvertently canted in opposition to the inclination that matches the shoulders 51 and 52.

It may be noted that, with the insulating pad 49 and insulators 54, the rail 22*a* is electrically isolated from ground, and may be used as a conductor in, for example, an electrically conductive rail signalling system or the like.

Figure 23:
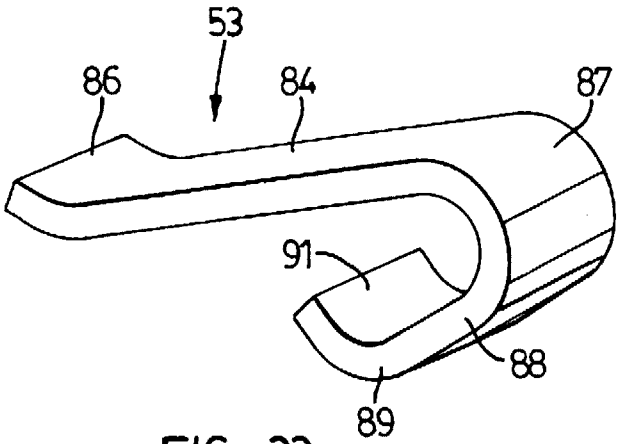
FIGS. 22 and 23 are side and isometric views, respectively, of the rail clip used in the fastening arrangement of FIGS. 8 to 10.
Figure 22:
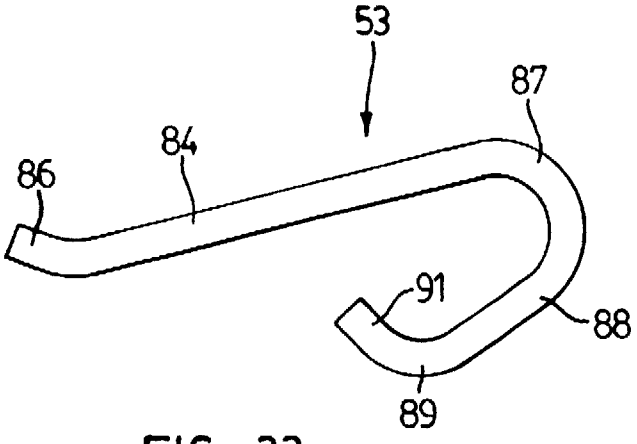

The rail clip 53 employed in FIGS. 8 to 10 is formed of bent metal strip and as seen best in FIGS. 9, 22 and 23, comprises an upper limb portion 84 that reacts with the abutment surface 77, a preferably upswept inner end or distal portion 86 that bears resiliently downwardly on or toward the flange 48 of the rail 22*a*, for restraining the rail 22*a* against vertical movement, an outer portion 87 curving laterally arcuately outwardly and downwardly toward a lower limb portion 88 extending to a lower portion 89 that rests in the pit 63 and bears on the extension 62, and an upwardly directed end portion 91.

The lower portion 89 is offset laterally inwardly from the centre of curvature of the arcuate portion 87. As result, when the end portion 86 is loaded upwardly as a result of uplift of the rail flange 48, there is a stress reversal within the clip 53 and a zone of zero stress whereby the stresses are distributed more uniformly through the body of the clip 53 and stress concentrations are avoided.

In use, after installation of the cant plates 49, shoulders 51 and 52, insulators 54 and laying of the rails 22*a* and 22*b*, the inner ends 86 of the clips 53 are inserted loosely through the openings 71 to rest on the portion 74 of the insulators 54 and pressure applied on the outer portions 87 to cause the lower portion 89 to ride inwardly upwardly over an outer arcuate ramp portion 93 of the extensions or seating portion 62. At this point the upper portion 84 of the clip 53 is compressed by the abutment surface 77 and the clip 53 is driven inwardly until the lower portion 89 snaps into the pit 63 in the installed position seen in FIG. 9.

In the installed position the compressive reaction on the clip 53 between the surfaces 63 and 77 result in a strong downward toe load exerted on flange 48 by end portion 86.

Figure 25:
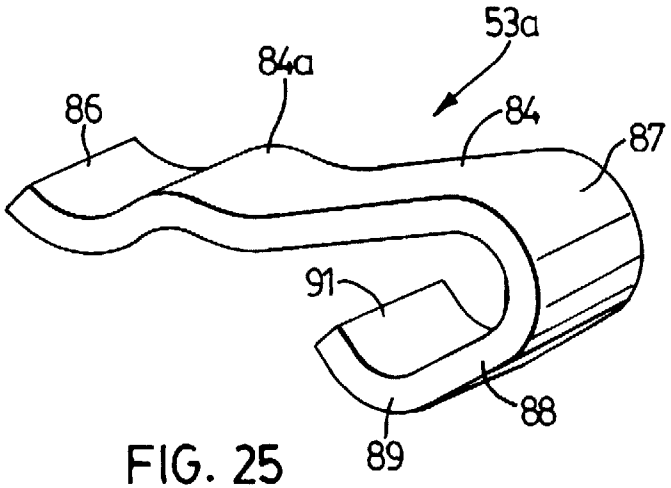
FIGS. 24 and 25 are side and isometric views, respectively, of a modified form of rail clip.
Figure 24:
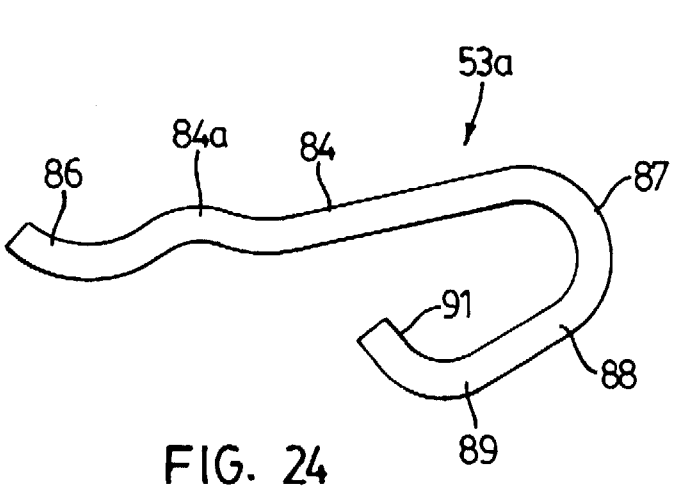
Figure 26:
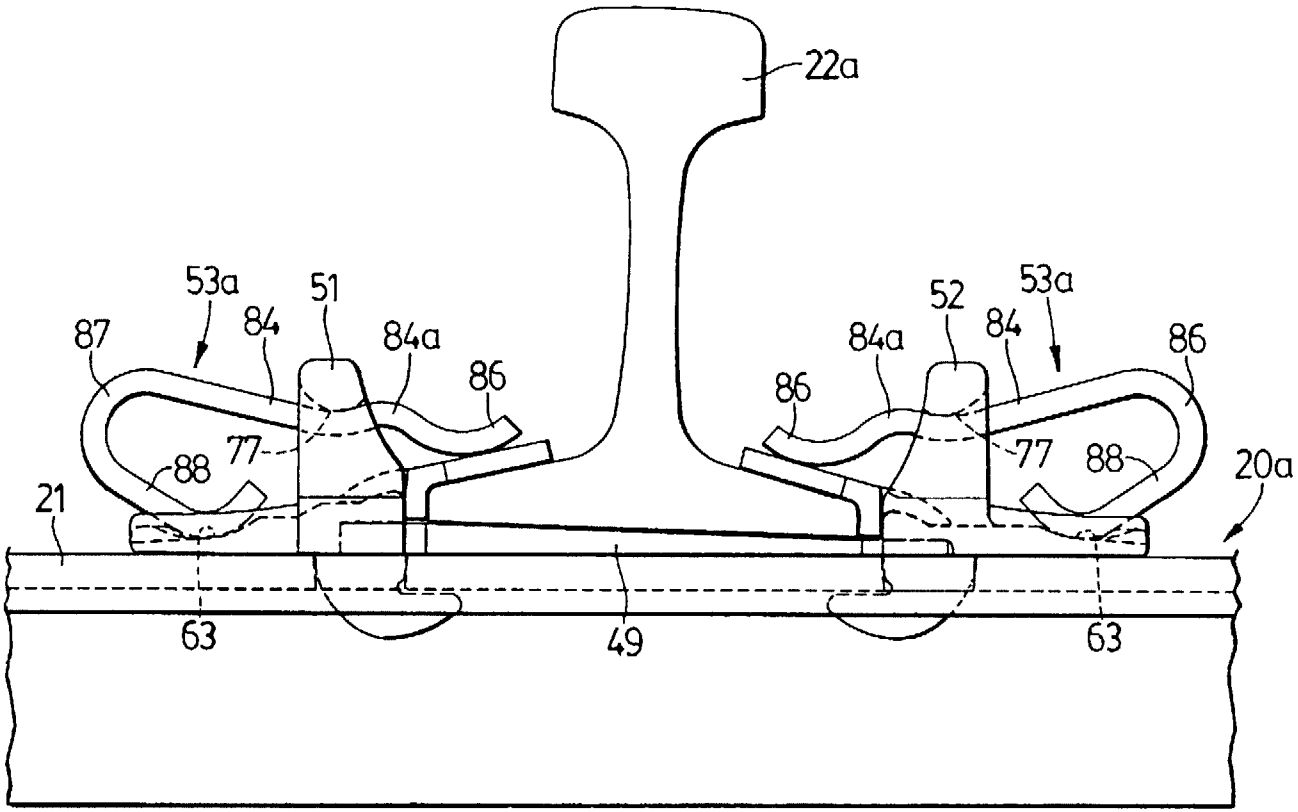
FIG. 26 is a view corresponding to FIG. 9 showing the use of the modified clip of FIGS. 24 and 25.

Referring to FIGS. 24 to 26, a modified clip 53*a* comprises an upwardly bowed portion 84*a* in the upper limb portion 84 extending inwardly adjacent the abutment surface 77 in the installed position, as seen in FIG. 26. The upwardly bowed portion 84*a* engages the surface 77, and provides increased resistance to migration of the clip 53*a* outwardly from its installed position as a result of impacts or vibration encountered in service.

Figure 27:
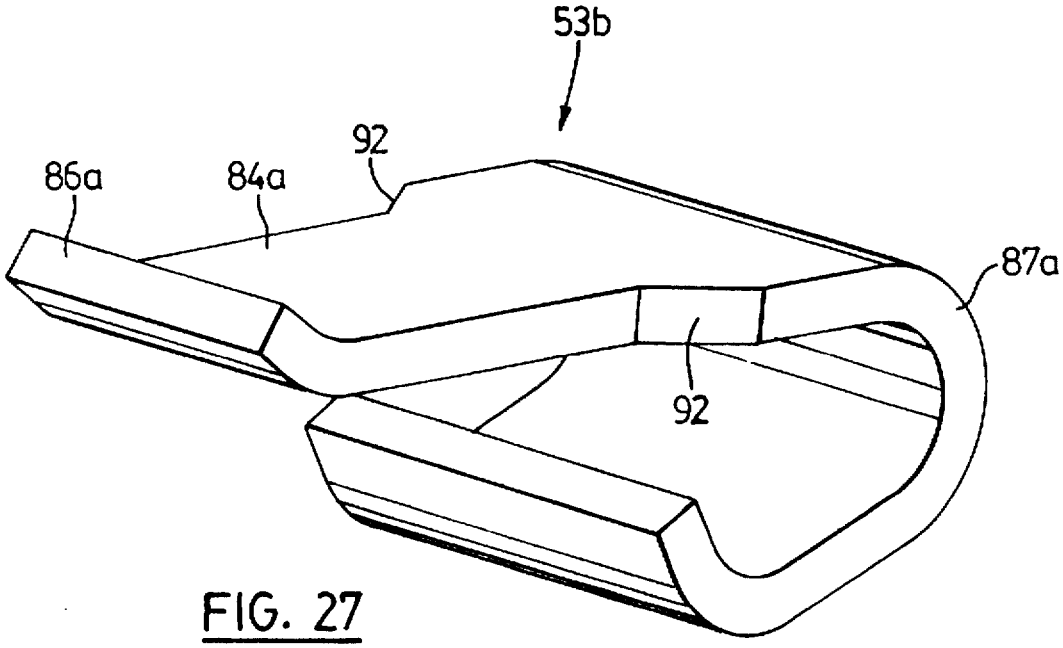
FIG. 27 is an isometric view of a modified form of clip.

FIG. 27 shows a clip 53*b* generally similar to the clip 53 except the upper limb 84*a* and end portions 86*a* are of reduced width measured in the longitudinal direction with reference to rail 22*a* as compared with the arcuate portion 87*a* and remaining portions of the clip, whereby the clip is provided with generally laterally inwardly inclining faces or shoulders 92 that may be engaged by tools and facilitate mechanized installation and deinstallation of the clips.

Figure 28:
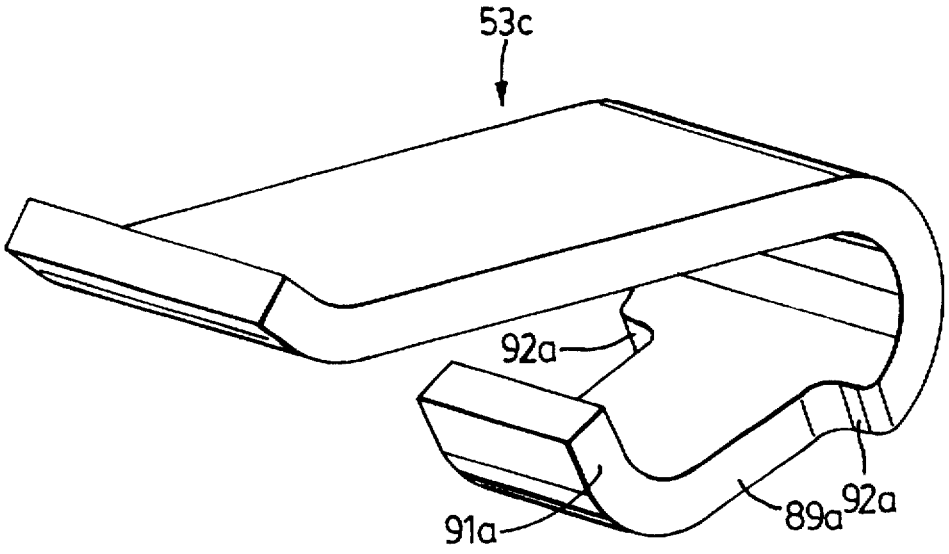
FIG. 28 is an isometric view of a further modified form of clip.

FIG. 28 shows a further example 53*c* providing laterally inwardly arranged tool-engaging faces 92*a* except in this instance the lower limb portion and inner end portion 89*a* and 91*a* are of reduced width.

Figure 29:
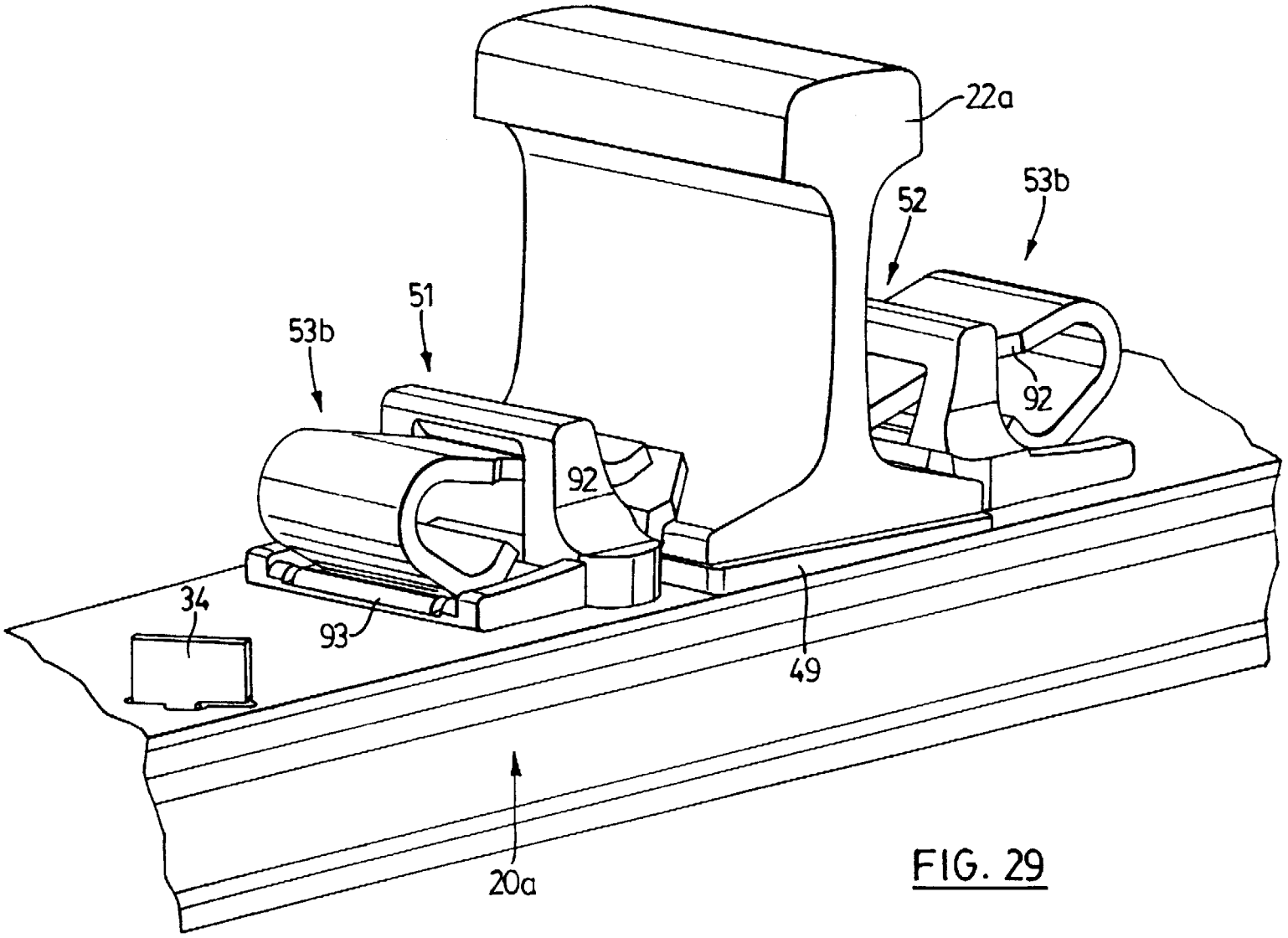
FIG. 29 is a view corresponding to FIG. 10 illustrating use of the modified clip of FIG. 27.

FIG. 29 is a view generally similar to FIG. 10 showing the installed clip 53*b* of FIG. 27 and illustrating how the faces 92 are exposed for engagement by a tool for deinstallation or installation.

Figure 30:
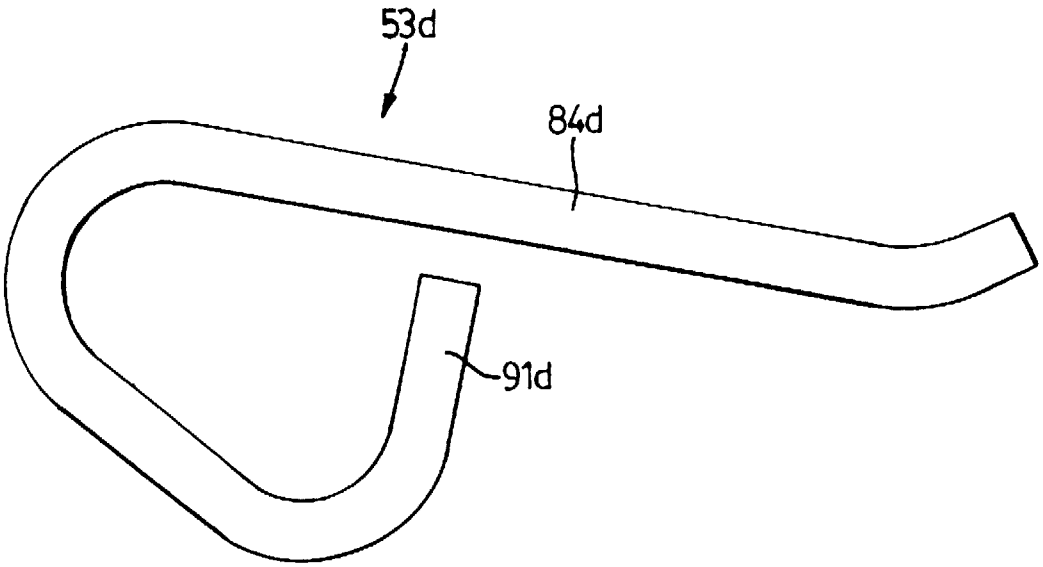
FIG. 30 is a side view of a further modified form of clip.

FIG. 30 shows a further example of a clip 53*d* similar to the clip 53 of FIG. 22 except the end portion 91*d* approaches more closely toward the upper limb portion 84*d*. The clip 53*d* is less compliant than the clip 53. Generally, it is preferred that a clip which is more compliant, as shown in FIGS. 22 to 25, 27 and 28, be employed so that deflection of the upper limb portion 84 toward the end portion 91, such as may occur during installation of the clip is not usually limited by contact between the portions 84 and 91.

Figure 31:
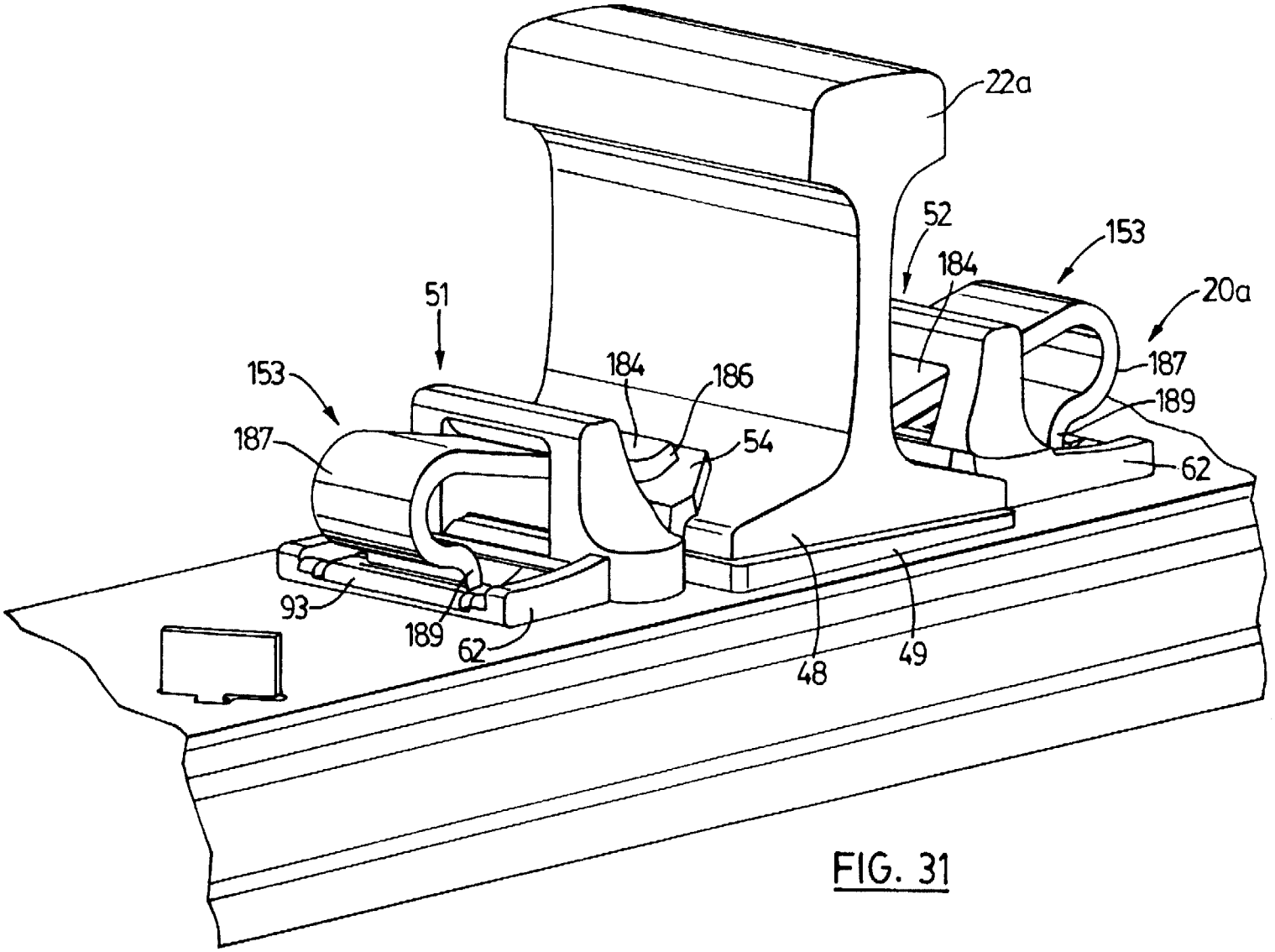
FIG. 31 is a view corresponding to FIG. 10 showing use of a still further modified form of clip.
Figure 32:
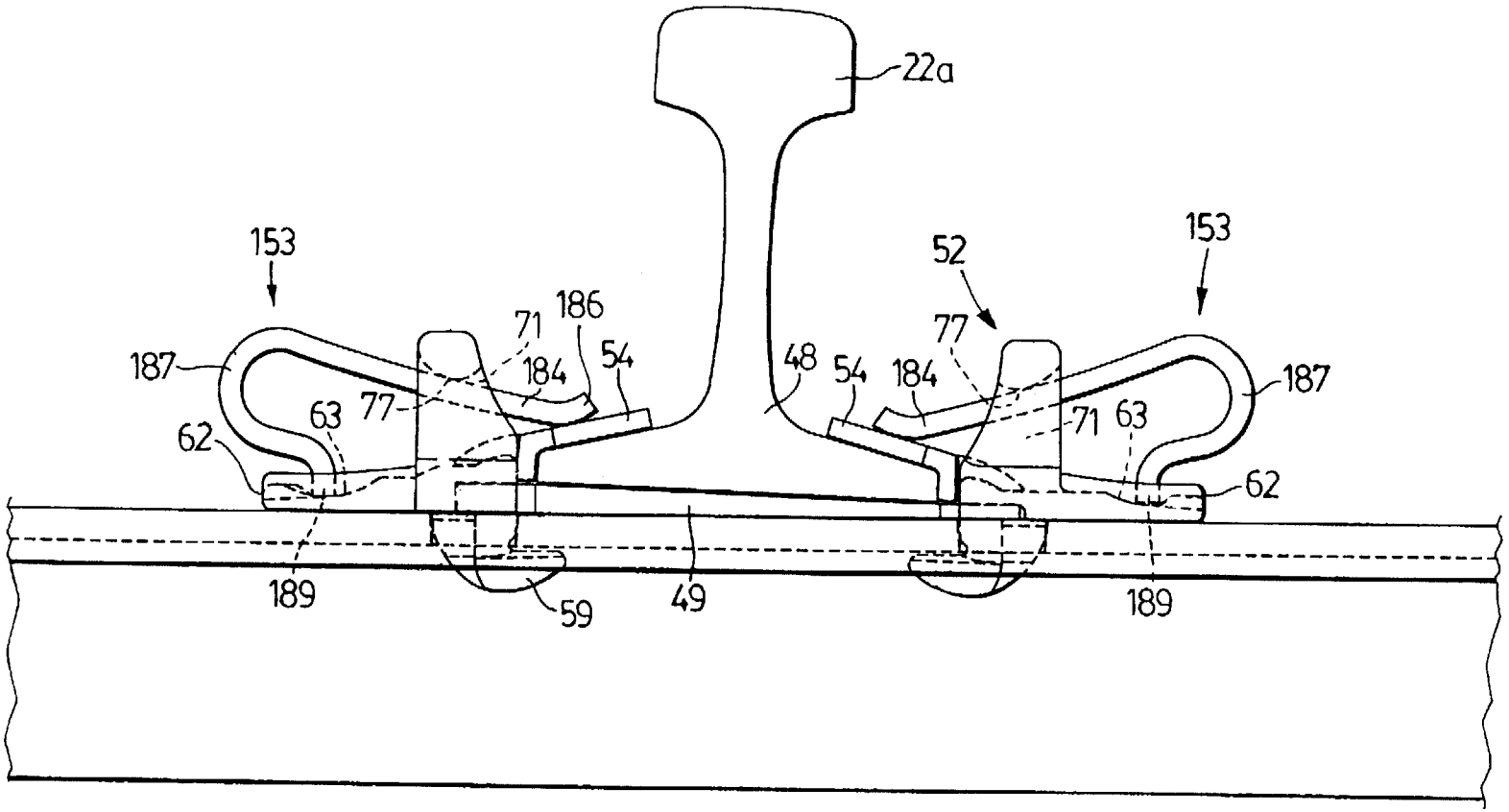
FIG. 32 is a side view, with internal structure shown in broken lines of the arrangement of FIG. 31.

FIGS. 31 and 32 show a rail fastening similar to that of FIGS. 9 and 10, except the clip 153 is irremovable except by the application of special tools. Parts similar in function to those of the clip 53 of FIG. 22 are denoted by similar reference numerals raised by 100.

It may be noted that, similar to the clip 53, clip 153 has a lower portion 189 that bears on the extension 62 and is offset inwardly from the centre of curvature of the portion 187 to provide improved stress distribution as discussed above. In this case, however, the portion 189 extends downwardly into the pit 63. In installation, the end portion 186 may be inserted loosely manually into the opening 71 and the rear of the portion 187 given blows with a driving tool such as a hammer or slug to drive the clip 153 inwardly toward the position shown in FIGS. 31 and 32. The inner end portion 186 is urged upwardly as it rides on the upwardly inclining surface of the rail flange 48 or the insulator 54 disposed thereon, and the upper limb 184 is compressed more strongly as it progressively enters the opening 71. As a result, there is a strong downward compressive reaction at the lower portion 189. As the clip 153 is driven inward, the end portion 189 rides up the arcuate ramp portion 93 of the extension 62 and snaps into the pit 63 when it reaches the installed position. Because of the compressive reaction, the edges of the lower portion 189 tend to engage firmly in or bite in the surface of the pit 63, and therefore tend to resist attempts to lever the clip 153 outwardly from the shoulder 51 or 52, and therefore rendering the fastening device resistant to vandalism. The clip 153 may be removed by application of a special tool for example an hydraulically powered compression device which compresses the portions 184 and 189 toward one another in order to free the lower portion 184 from the pit 66 and permit lateral outward withdrawal of the clip 153.

An advantage of the clips of the invention is that they allow separation of the installation stresses from in service stresses. Because of the stress reversal and improved stress distribution, the arcuate portion 87 or 187 is subject to relatively less stress or loading in service in resisting a tendency for the rail flange 48 to lift upwardly, for example to prevent rail rollover.

With the clips of the invention, therefore, the arcuate portions 87 or 187 may be made relatively thin, so that the clip as a whole is rendered compliant and easy to install, while still offering adequate strength to resist uplift of the rail flange.

Figure 33:
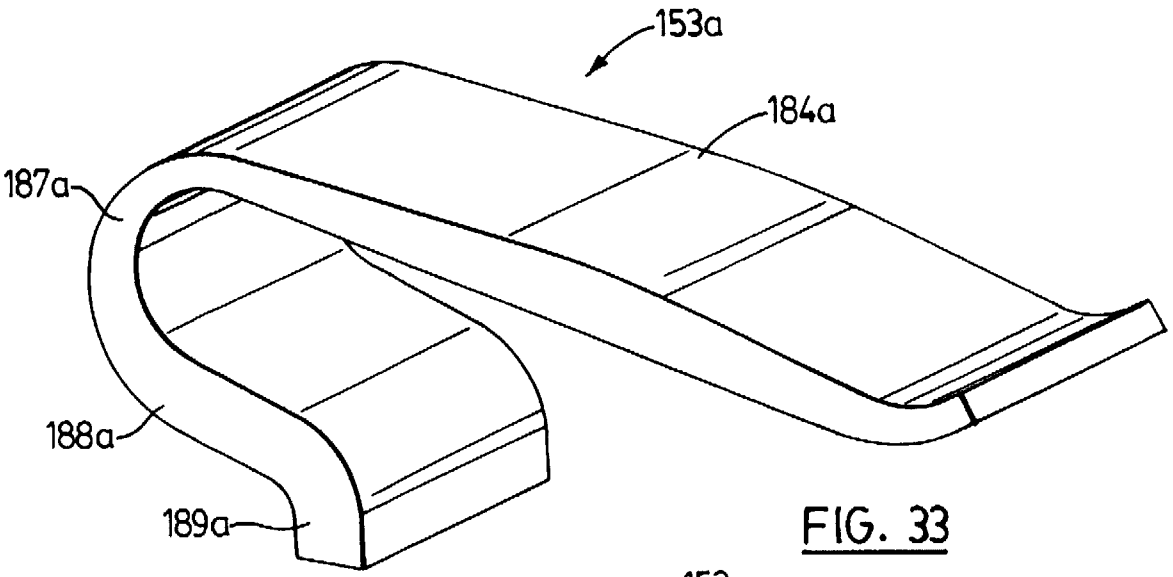
FIGS. 33 and 34 are isometric and side views, respectively, of a further modified form of rail clip.
Figure 34:
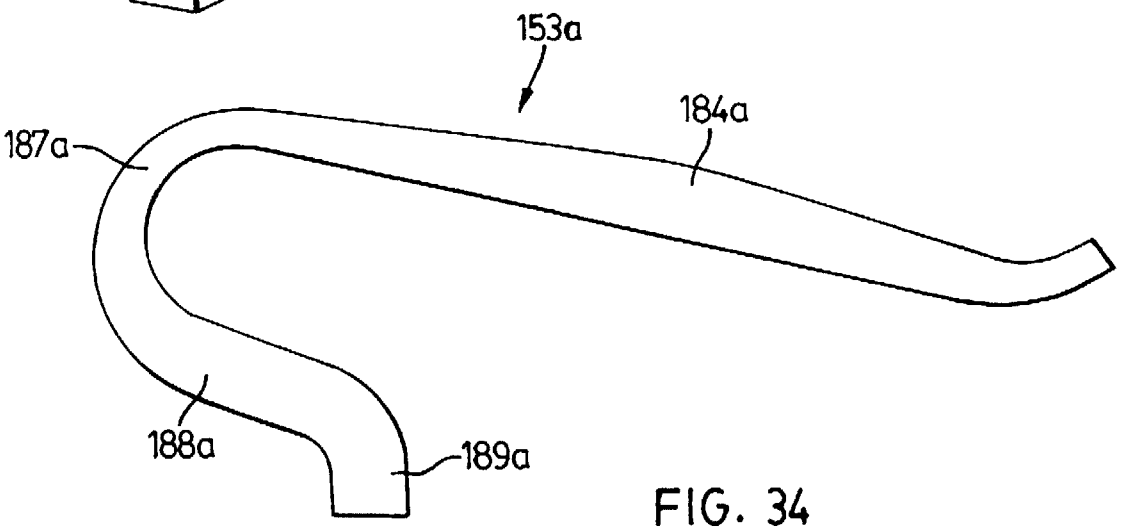

FIGS. 33 and 34 show a modified form of clip 153*a* having a relatively thin arcuate portion 187*a*, so that the clip is relatively easy to install. The clip has a thickened upper limb portion 184*a*, lower limb portion 188*a* and lower portion 189*a* to provide a desired stiffness and resistance to rail flange uplift.

Figure 35:
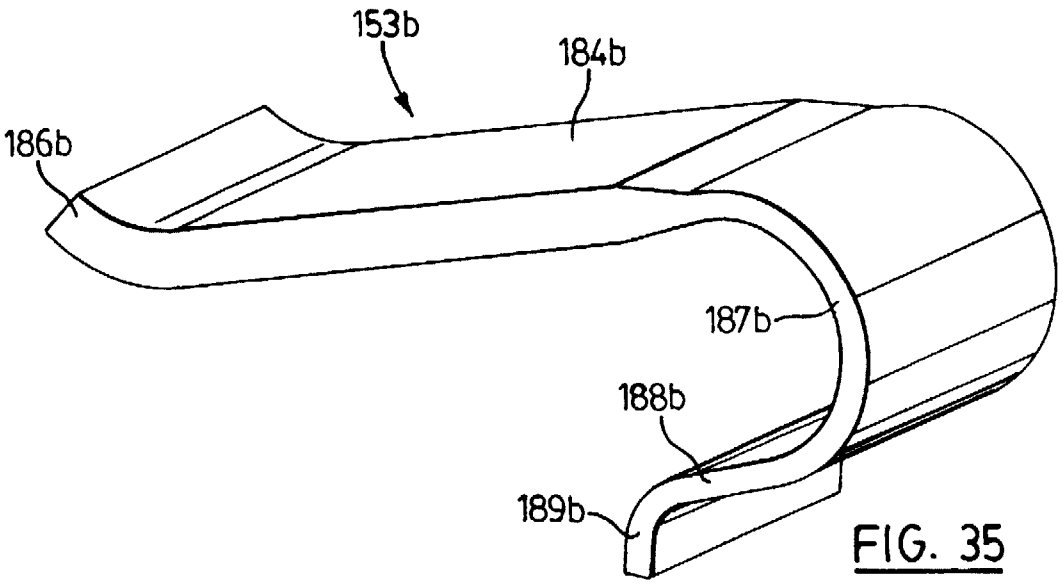
FIGS. 35 and 36 are isometric and side views, respectively, of a further form of rail clip.
Figure 36:
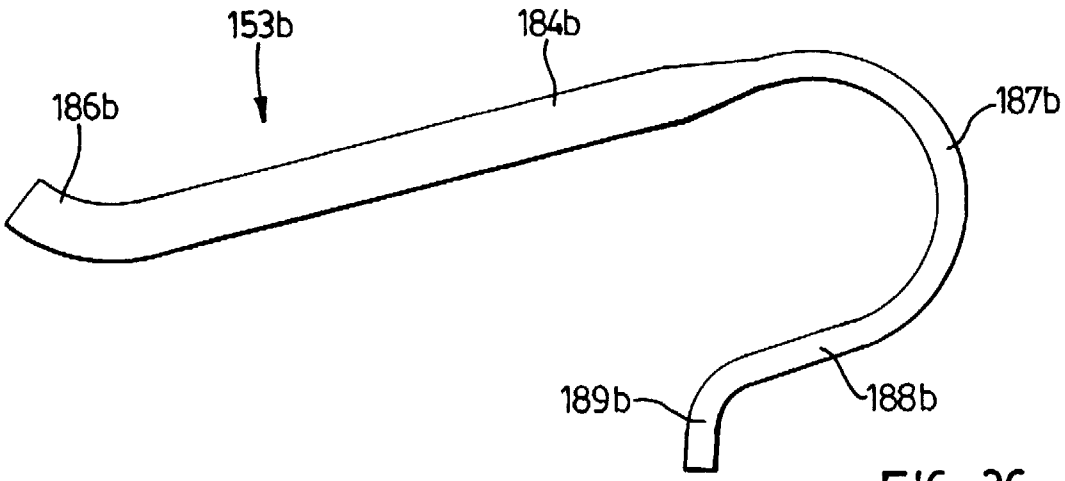

FIGS. 35 and 36 show a further modified form of clip 153*b* wherein the arcuate portion 187*b*, lower limb 188*b* and lower portion 189*b* are thin rendering the clip especially compliant and easy to install while the upper limb portion 184*b* and inner end portion 186*b* are relatively thick to provide adequate stiffness to resist rail flange uplift.

Figure 37:
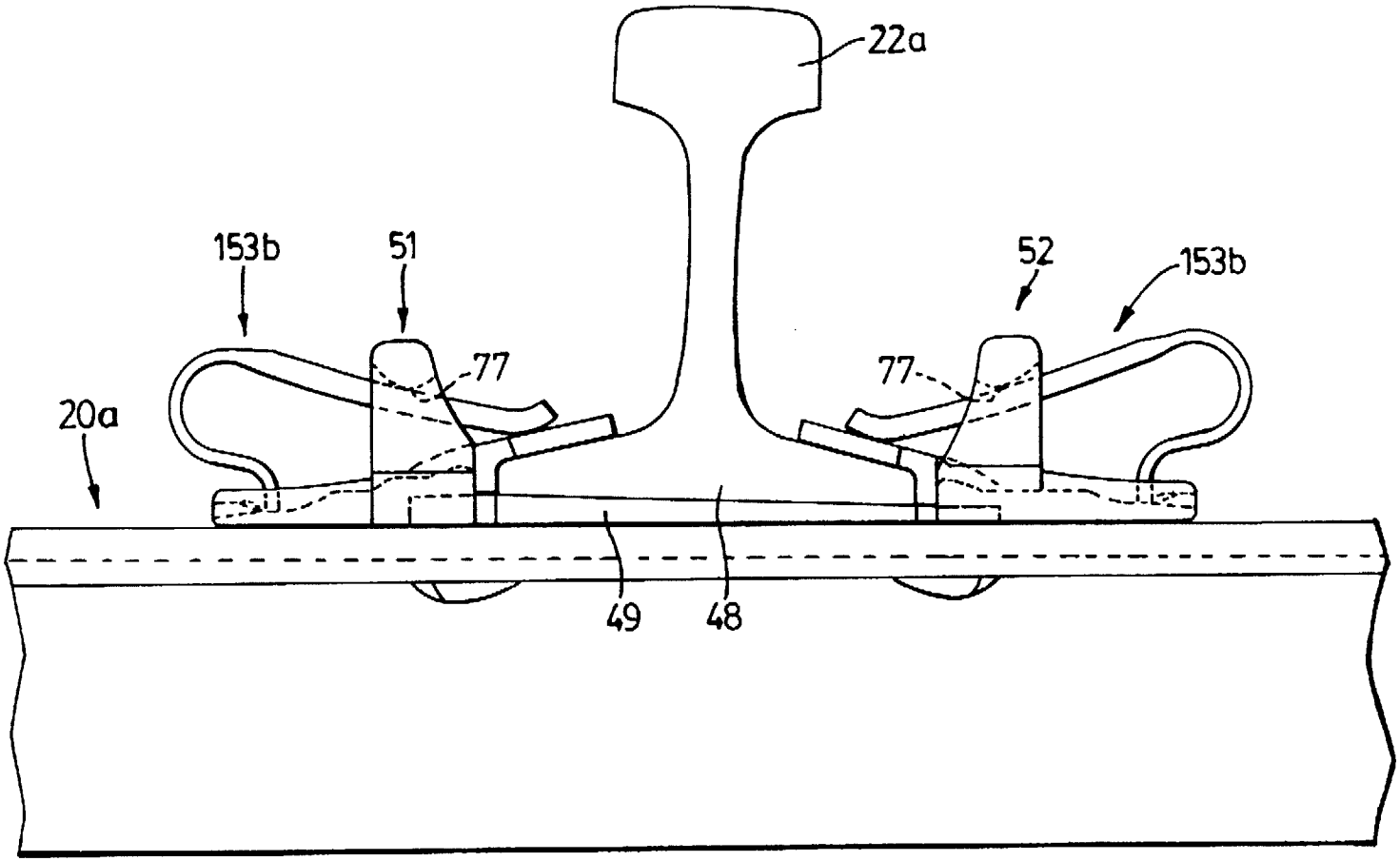
FIG. 37 is a view corresponding to FIG. 9 showing use of the rail clip of FIGS. 35 and 36.

FIG. 37 is a view similar to FIG. 9 showing the clip 153*b* in installed position.

Figure 38:
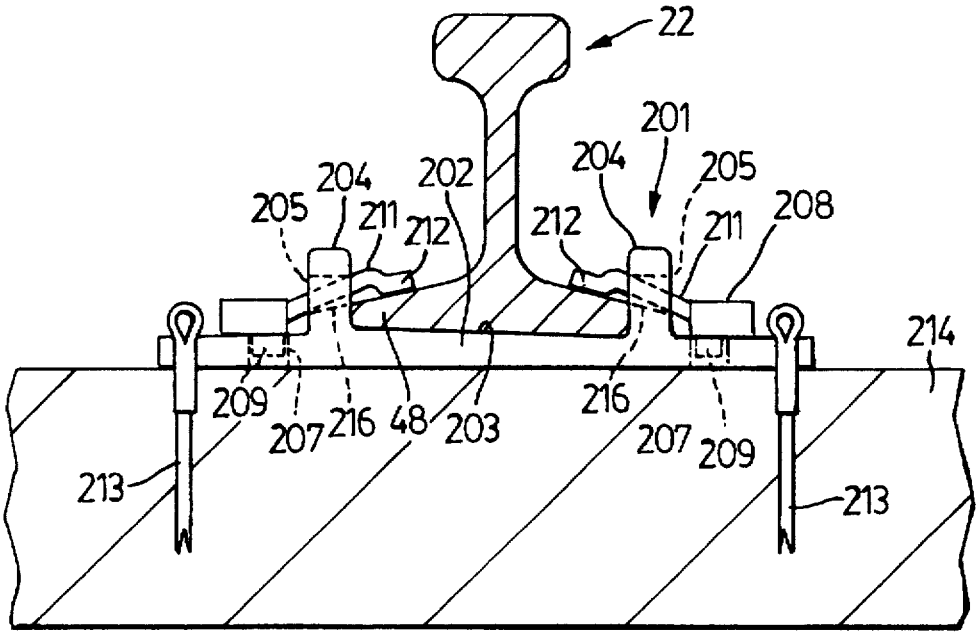
FIG. 38 is an end view, partly in section of a plate and clip applied to a wood tie.
Figure 39:
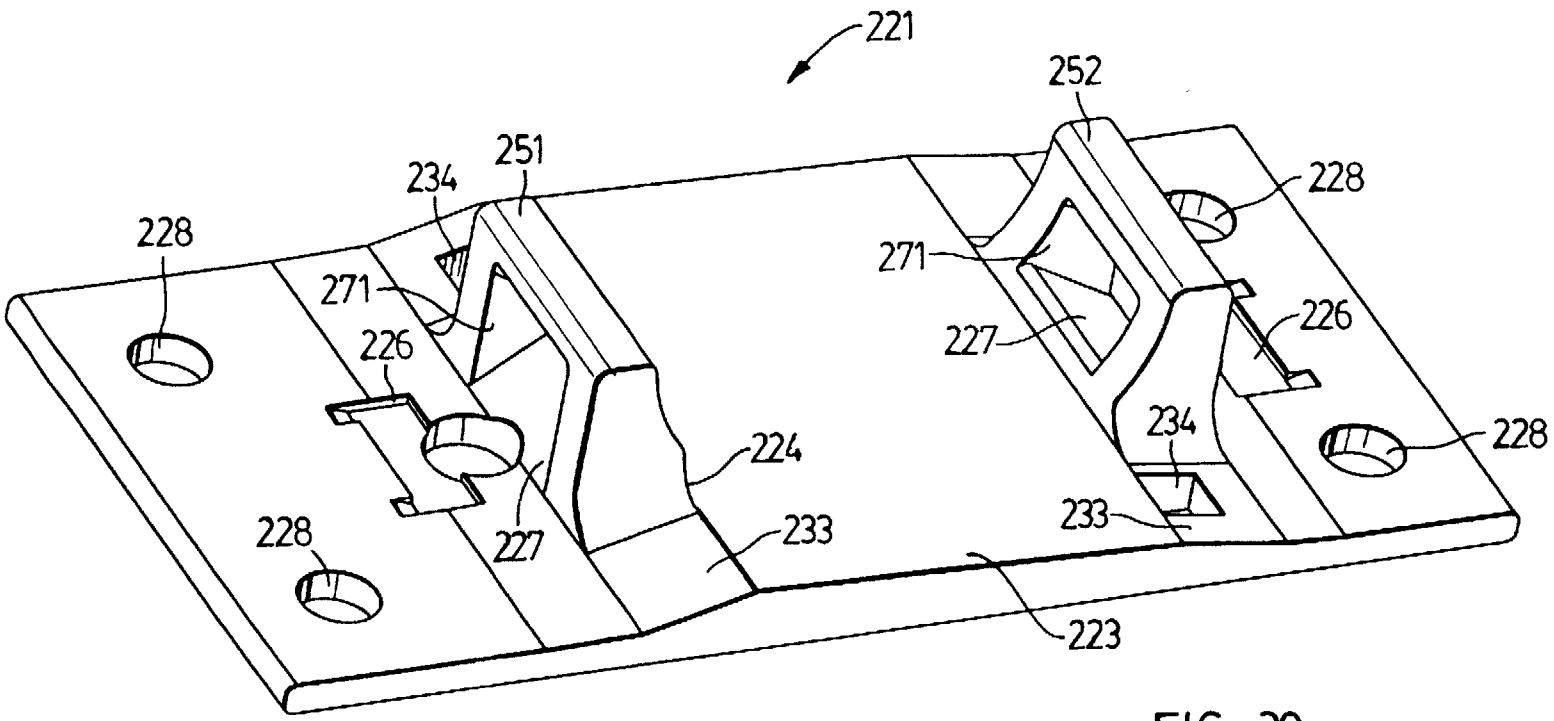
FIG. 39 is an isometric view of a further form of rail tie plate in accordance with the invention.
Figure 40:
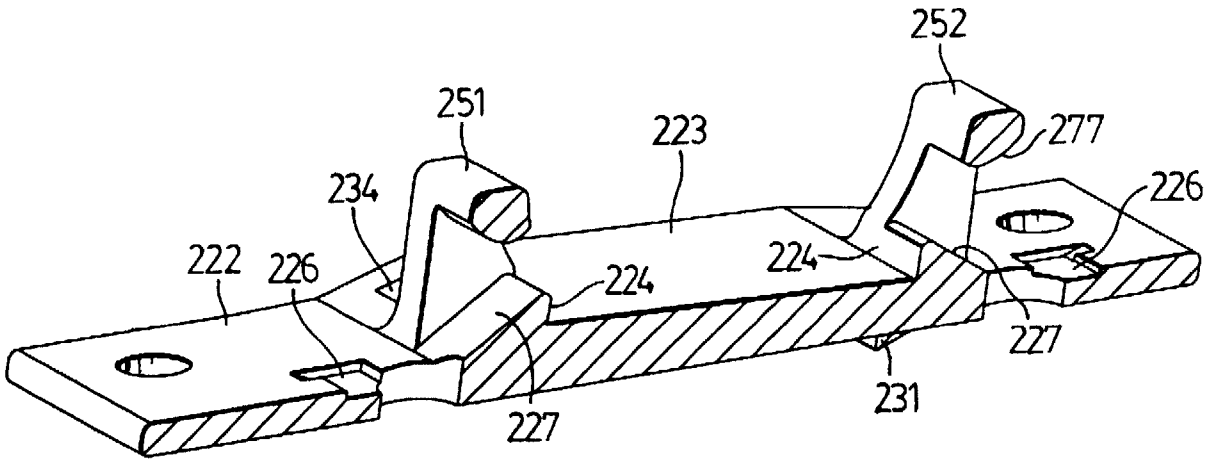
FIG. 40 is a view of the plate of FIG. 39 with portions broken away to show interior structure.
Figure 41:
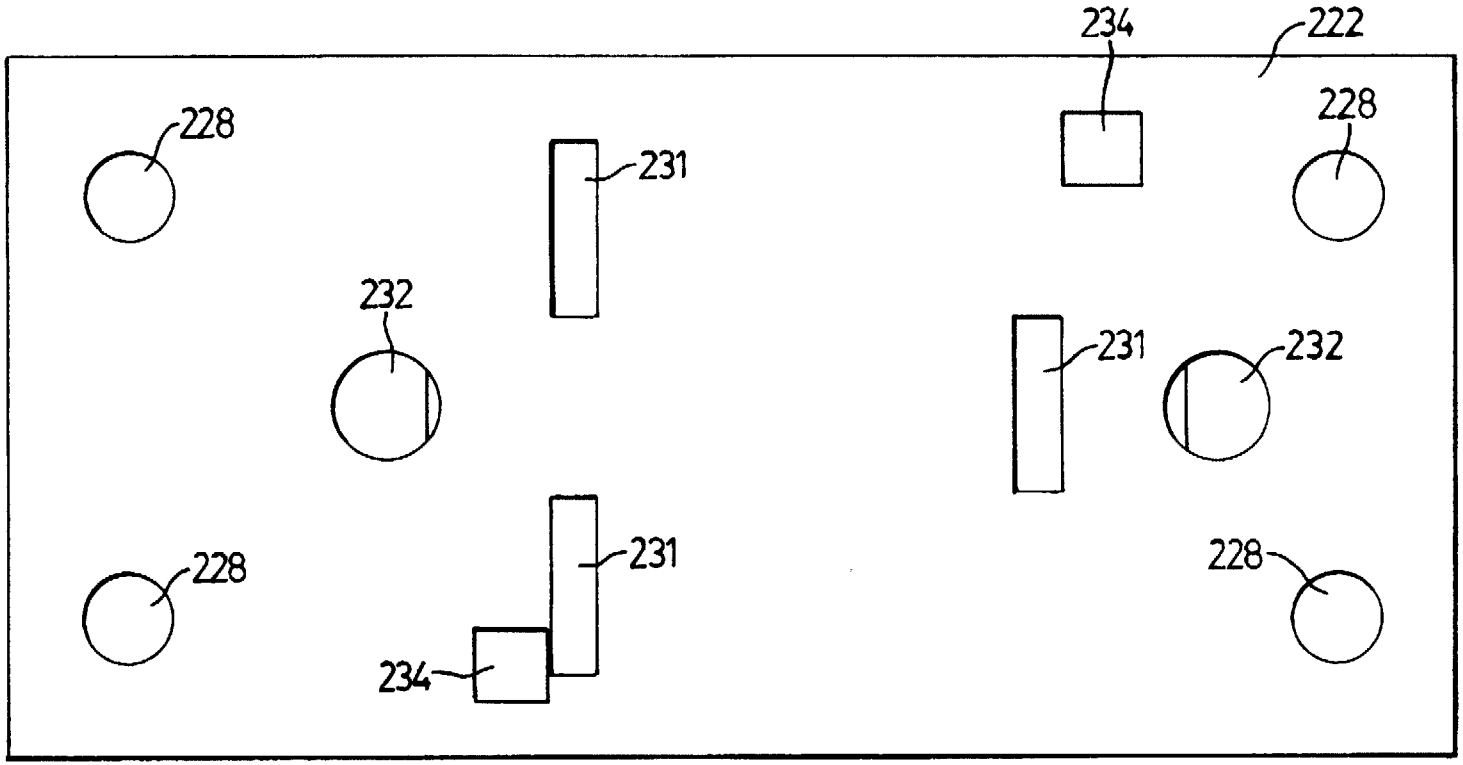
FIG. 41 is a bottom plan view of the plate of FIGS. 39 and 40.

FIG. 38 shows a tie plate 201 formed in a single piece, for example by casting, suitable for installation on a concrete or wood tie. The plate 201 comprises a generally rectangular plate formed base 202 generally similar in its shape, configuration and mode of use to the tie plate described hereinafter with reference to FIGS. 39 to 46. The plate has a central portion with an inclined upper surface 203 to provide for cant of the rail 22. Upstanding from the plate 202 are two abutment members 204 having openings 205 through them somewhat similar to the opening 71 in the shoulder portions 51 and 52 described above with reference to FIGS. 9 to 14.

Outwardly from each portion 204, the plate 202 is formed with a pair of openings 207 spaced longitudinally apart.

In FIG. 38, the plate 201 is used with rail clips 208 having a longitudinally elongated generally rectangular base portion with a planar lower side. Each end of the base portion is formed with a downwardly extending tab 209 spaced inwardly from a laterally outer side edge of the clip 208. An intermediate portion 211 inclines laterally inwardly and upwardly from the base portion of the clip 208 to a transition portion 211 curving downwardly to provide a convex upper side and an end portion 212 curving upwardly to provide a convex lower side.

The ends of the plate 202 extend a distance beyond the upstanding portions 204 and are provided with openings through which anchor members such as spikes 213 may be driven into a wooden tie 214. These openings may also receive studs or other conventional cast in place anchors of a concrete tie, for example.

In use, after installation of the plate 201 on a tie, the end portions 212 of the clips 208 are introduced through the openings 205 and are driven inwardly for example by pressure or blows applied on an outer edge to the installed position seen in FIG. 38 wherein the tabs 209 snap into the openings 207, the lower side of the end portion 212 bears on the upper side of the rail flange 48, and the upper side of the intermediate portion 211 bears on the abutment surface formed by the upper side of the opening 205.

The lower side 216 of each opening 205 comprises an upwardly inclining ramp surface, somewhat similar to the ramp surfaces 72 and 76 described above with reference to the shoulders 51 and 52 to facilitate insertion of the inner end portions 212 of the clips 208, and to guide them to the installed position on the upper side of the rail flange 48.

FIGS. 39 to 46 show further examples of a tie plate 221 especially although not exclusively adapted for application to a wood tie.

Figure 46:
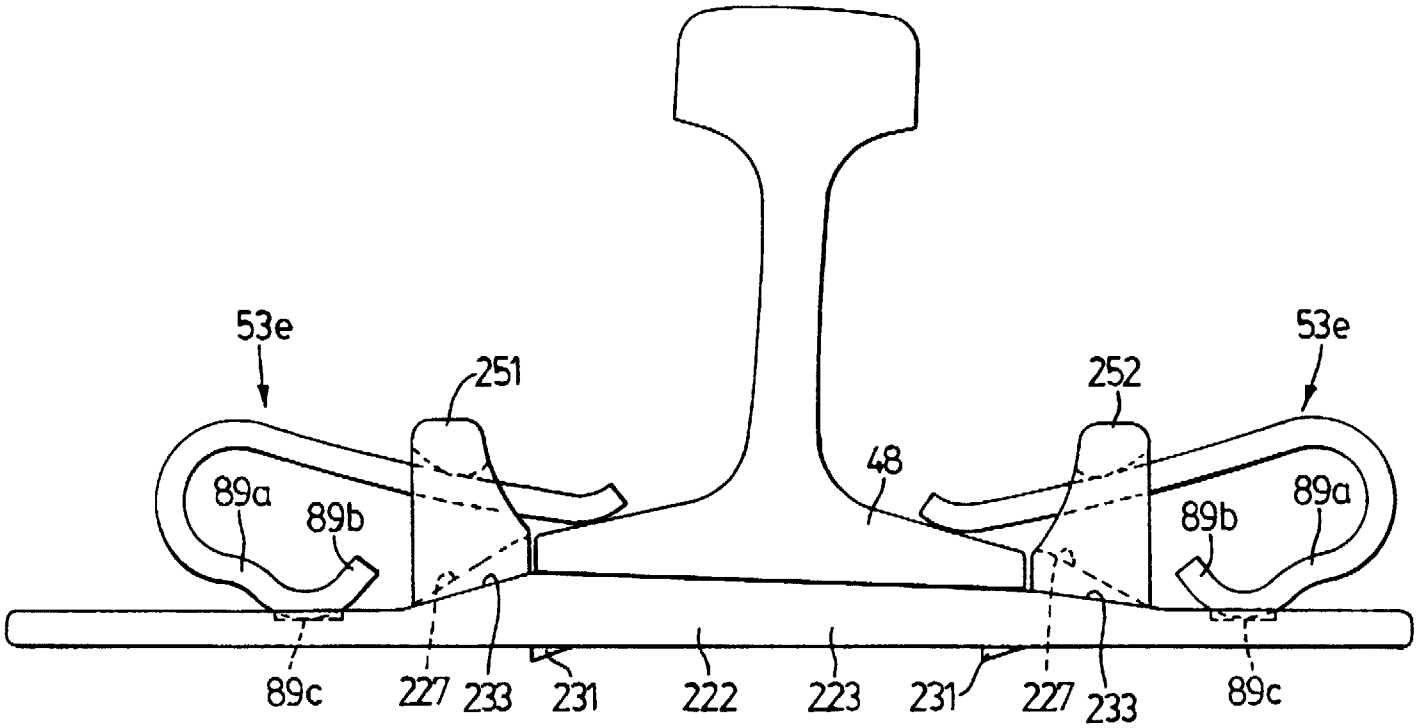

The tie plate comprises a one piece casting having a generally rectangular plate-formed base 222 with a generally thickened central portion 223 providing a wear surface for reception of the rail flange 48. In the present example, the plate serves as a cant plate and the central portion 223 tapers in thickness, as best seen in FIGS. 43 and 46.

Upstanding from the plate 222 are two abutment members 251 and 252, somewhat similar to abutment portions 51 and 52 described above, having openings 271 through them providing downwardly facing abutment surfaces 277 for reaction with rail clips, such as a rail clip 53 as described above with reference to FIGS. 8 to 10, 22 and 23. In this example, the members 251 and 252 are spaced apart such that their lower inner surfaces 224, as seen in FIG. 43, snugly accommodate the rail flange 48 between them.

Outwardly from each opening 271, the upper side of the plate 222 is formed with a recess, in this case a rectangular recess 226 for accommodating a lower portion of a resilient clip such as the lower portion 89 of the clip 53 of FIGS. 22 and 23, or lower portion 189 of an irremovable clip 153 as seen in FIGS. 31 to 37.

Figure 43:
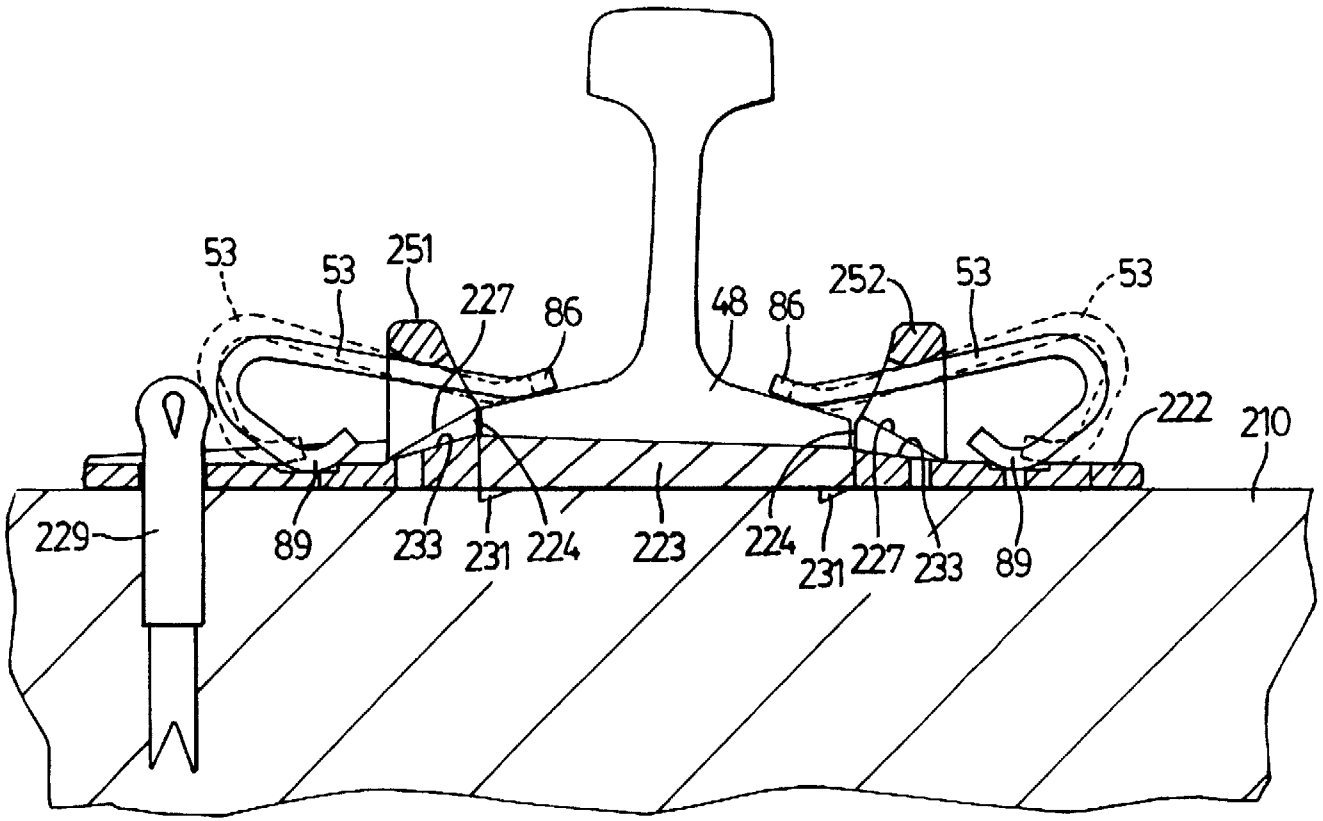
FIG. 43 is a side view partially in section showing the application of the fastening arrangement of FIG. 42 on a wood tie.

It will be noted that the lower portion of each opening 271 is defined by an inwardly upwardly inclining ramp surface 227 commencing at the plane of the upper side of the plate 202 adjacent the outer side of opening 257, and terminating as seen in FIGS. 43 and 21 at or slightly above the upper side of the flange 48 when received between the members 251 and 252.

Outwardly from the recesses 226, the plate portion adjacent each side is formed with a pair of openings 228 through which fastening members, such as spikes 229 may be passed to retain the plate 221 on a wood tie 230, as seen in FIG. 43, or which may receive studs or other cast in anchors of a concrete tie of the like.

In use, as seen in FIG. 43, a clip 53 may be inserted somewhat loosely through the opening 271 to the position shown in broken lines in FIG. 43 and driven inwardly to the installed position seen in solid lines. During initial application of the clips 53 to the plate 221, the inner ends 86 ride up the ramps 227, so that the outer edges of the flange 48 do not interfere with inward movement of the clips 53, thus greatly facilitating mechanized installation of clips such as clip 53.

A further advantage of the arrangement shown is that the box-form shoulders 251 and 252 offer considerably improved resistance to derailed dragging equipment.

In the preferred form, as seen in FIGS. 40, 41, 43 and 46, the lower side of the plate 222 is provided with wedge-shape projections 231 that taper laterally in the same direction as the central portion 223 and engage in the wood tie 230 and resist lateral displacement of the plates 221.

Desirably, adjacent each recess 226, the plate 222 is provided with a drainage hole 232.

Figure 17:
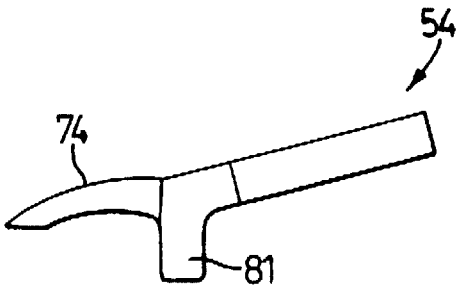

Desirably, as seen in FIG. 17, a transition portion 233 between the laterally outer portion of the plate 222 and the central portion 223 inclines inwardly upwardly and is provided with a rectangular opening 234 for reception of a conventional chisel-form rail road spike having a head engaging on the flange 48 as an adjunct to the use of the clips such as clip 53. Preferably, the openings 234 are offset from one another on opposite longitudinal sides of the members 251 and 252.

Figure 42:
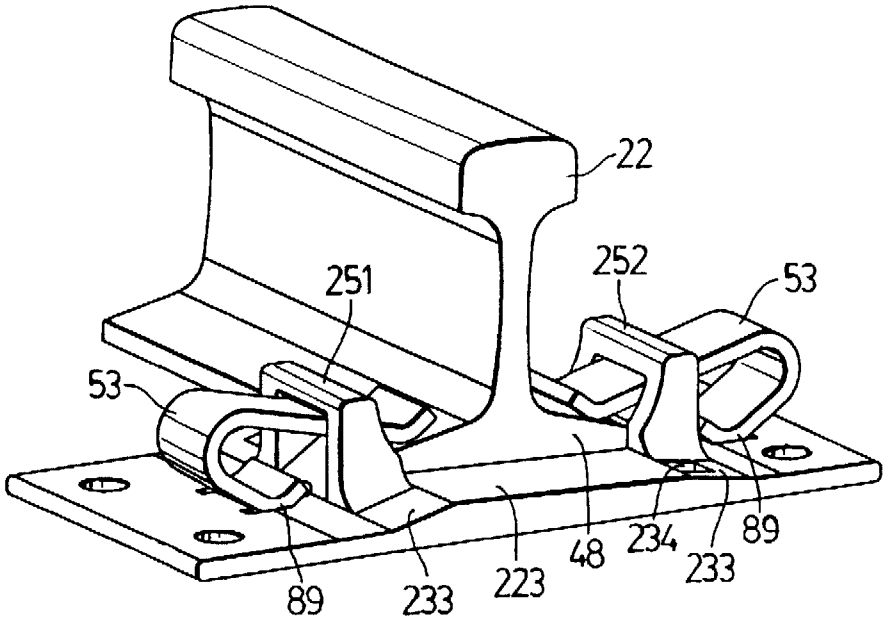
FIG. 42 is an isometric view illustrating application of the tie plate of FIGS. 39 to 41.
Figure 44:
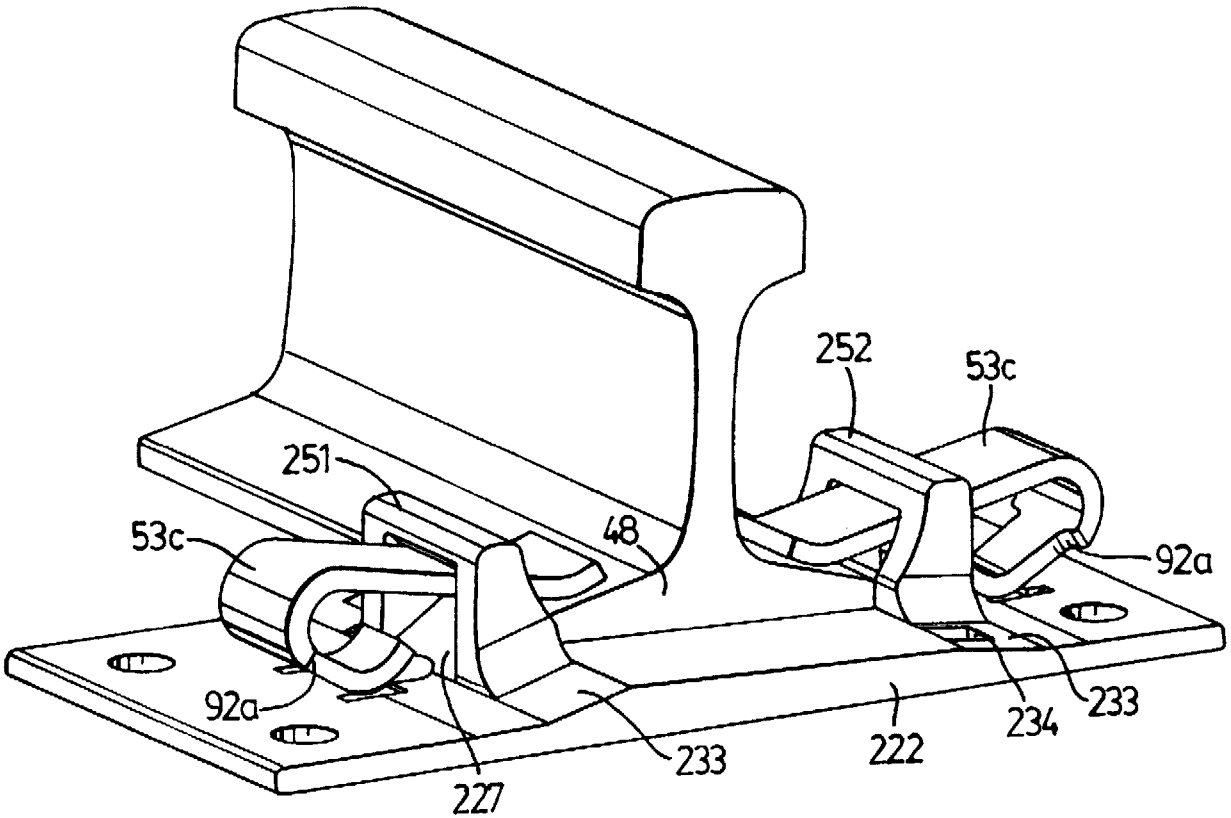
FIG. 44 is a view similar to FIG. 42 showing use of a rail clip as shown in FIG. 28.

FIG. 44 is a view similar to FIG. 42, showing the use of the clips **53*c* described above with reference to FIG. 28 having the lateral tool engageable shoulders 92*a***.

Figure 45:
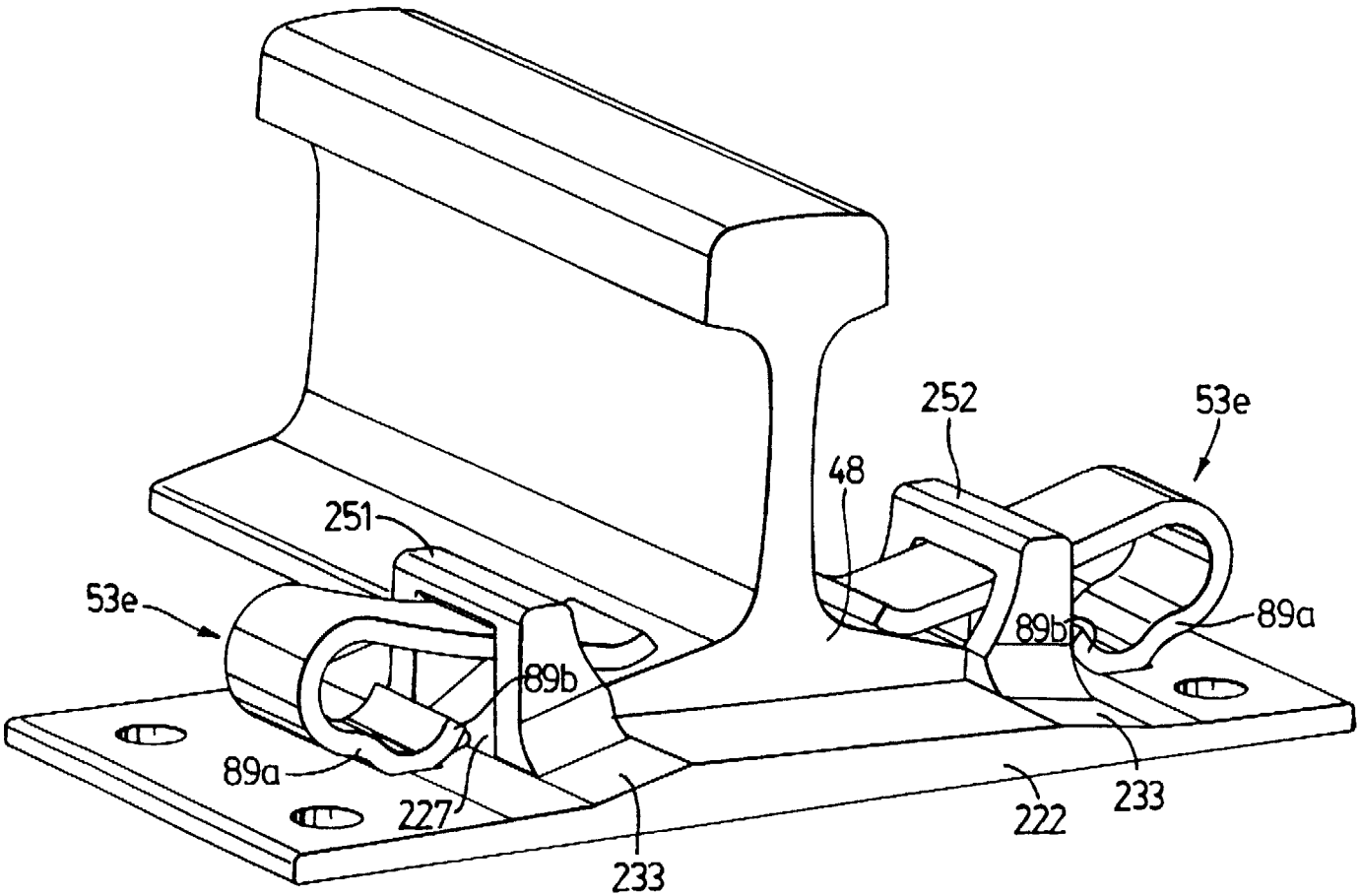
FIGS. 45 and 46 are views corresponding to FIG. 42 showing use of a further modified form of rail clip.

FIGS. 45 and 46 show a further modified form of clips **53*e*, generally similar in structure and function to the clip 53 described above except the lower portion comprises an upwardly bowed portion 89*a* merging transversely inwardly with an inwardly upswept portion 89*b*, whereby a lower portion 89*c* is provided between the portions 89*a* and 89*b* which is of somewhat smaller radius than the portion 89 of the clip 53 described above with reference to FIGS. 8 to 10, 22 and 23, and is somewhat better adapted to fit within the recesses 226 in the upper side of the plate 222**.

Figure 47:
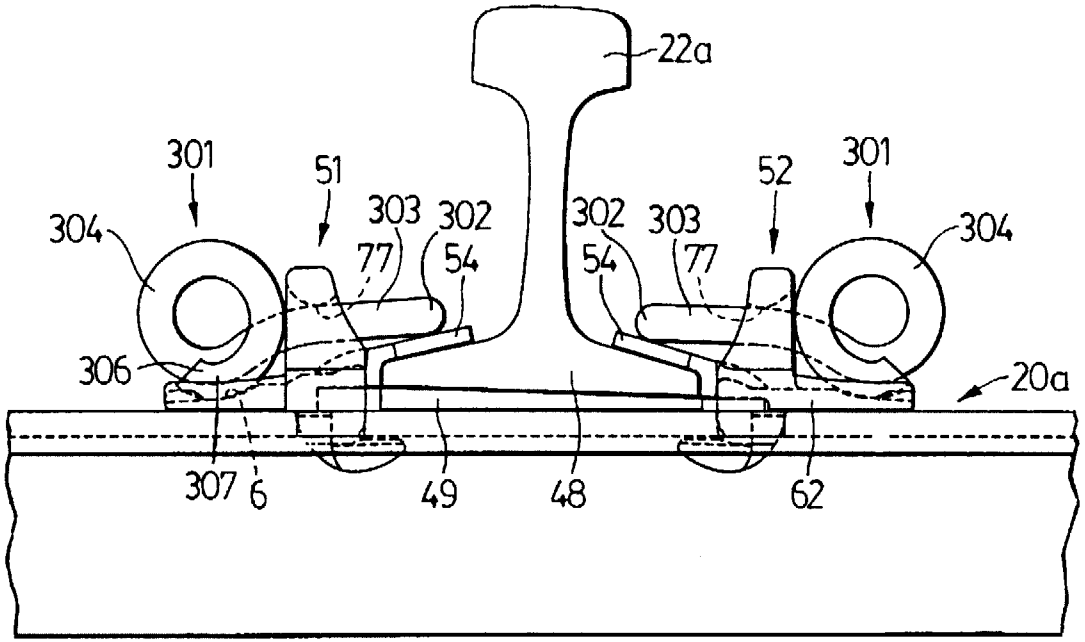
FIGS. 47 and 48 are views corresponding to FIGS. 9 and 10 showing use of a further form of clip.
Figure 48:
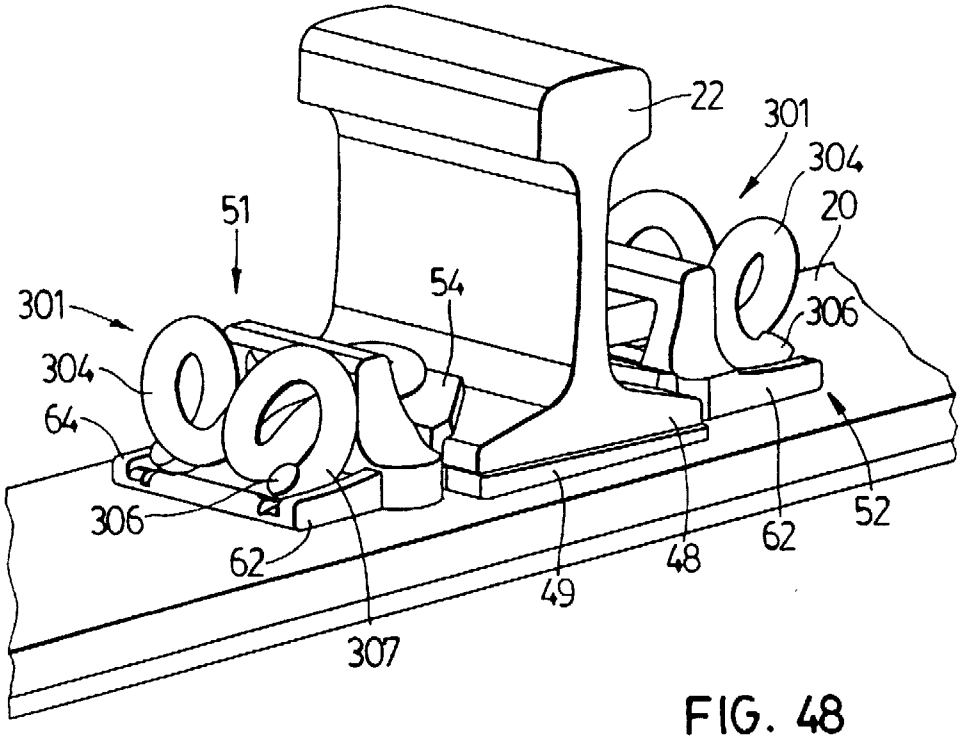
Figure 49:
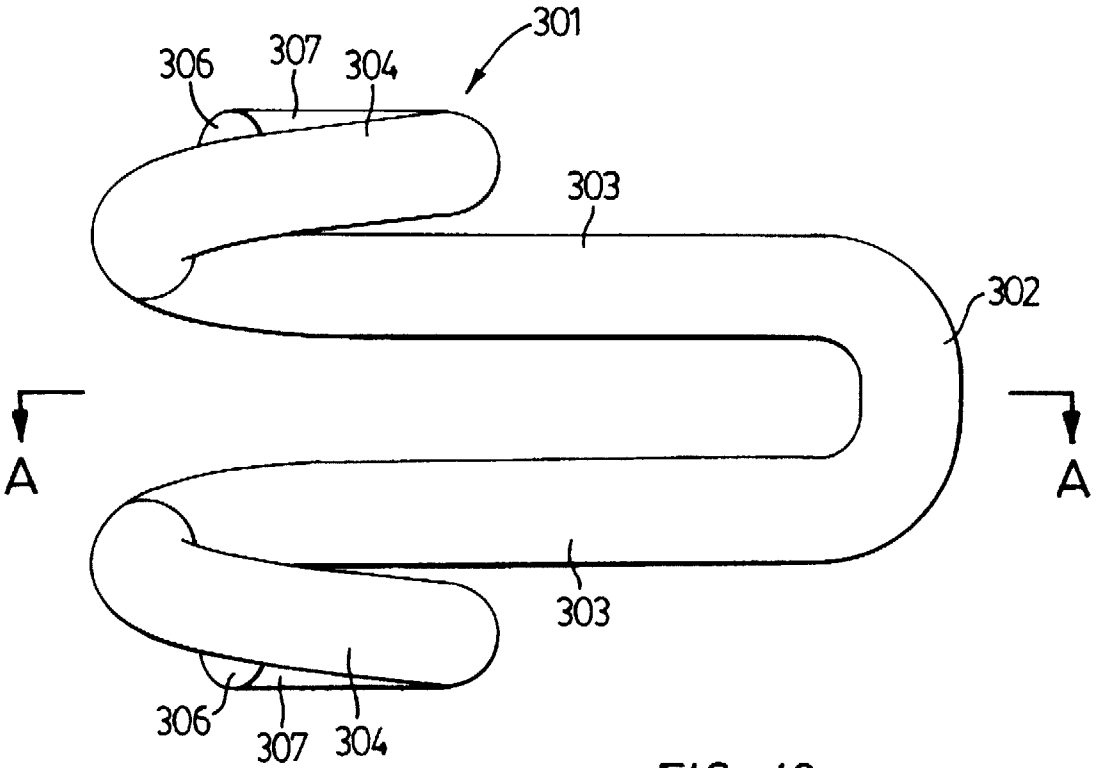
FIG. 49 is a plan view of the clip of FIGS. 47 and 48.

FIGS. 47 to 49 show examples of bent wire rod form clips 301 used with a fastening device similar to that described above with reference to FIGS. 8 to 21 on a tie **20*a* as described above with reference to FIGS. 7 and 8. The fastening device comprises hook-in shoulders retaining rail flange 48*a* seated on an insulating cant plate 49. The clips 301 bear on the flange 48 through insulators 54**.

Each clip 301 is in the form of a bent rod symmetrical about a vertical plane, for example the plane indicated at A—A in FIG. 49 and extending laterally of the rail **22*a* in the installed position. Each clip 301 comprises an inner central portion 302 which bears downwardly on the rail flange 48, downwardly outwardly inclining limb portions 303 which bear upwardly on the downwardly facing abutment surfaces 77 and outer portions 39 which bear resiliently on the seating portions 62 of the shoulders 51 and 52. Each outer portion 39 is in the form of a coil spring of which, as seen especially in FIG. 49 a substantial portion extends in a vertical plane parallel to the plane A—A, thereby reducing torsional stresses in the clip 301** in service.

In the example shown in FIGS. 47 to 49, the coil spring or spiral portion 304 extends arcuately, as seen for example in FIG. 47 through greater than 360° and terminates in an end portion 306 extending arcuately upwardly outwardly. An arcuate portion 307 spaced inwardly from the end 306 bears in the pit 63 of the seating portions or extension 62. Preferably, to increase resistance to squatting or compression of the coil portion 304, the end portion 307 are inclined with respect to the vertical plane A—A. In the example shown in FIGS. 47 to 49, the portions 307 are toed outwardly so that, on upward compression of the inner central portion 302 the end portions 307 engage compressively outwardly against the anti-squat wall portions 64. In other embodiments, the end portions 307 may be toed inwardly toward the plane A—A and may engage inwardly compressively on the end surfaces 67 of the portion 66 to provide resistance to compression-induced squatting.

By virtue of the fact that the coil spring portion 304 is a spiral extending arcuately through more than 360°, the rod form clip 301 is highly compliant. The generally vertical orientation of the coil spring 304 as seen in, for example, FIG. 49 greatly reduces the torsional stresses to which the clip is subjected in service.

FIGS. 50 to 54 illustrate a further wire rod form clip 401 used together with hook-in shoulders 51 and 52, a tie 20*a*, insulating cant plate 49 and insulators 54.

Figure 50:
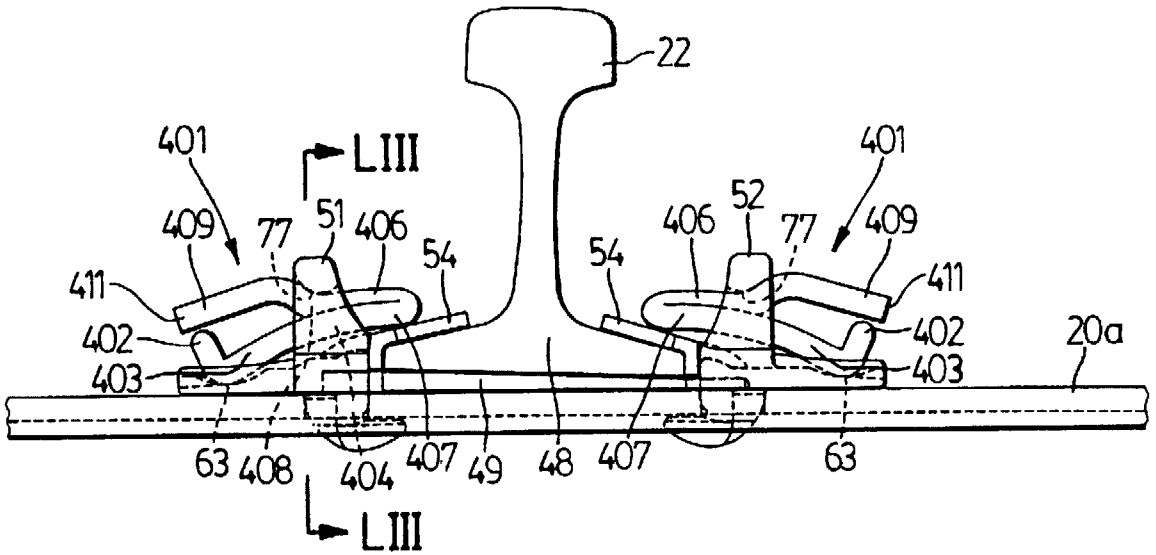
FIGS. 50 and 51 are views corresponding to FIGS. 9 and 10 showing use of a still further form of clip.
Figure 51:
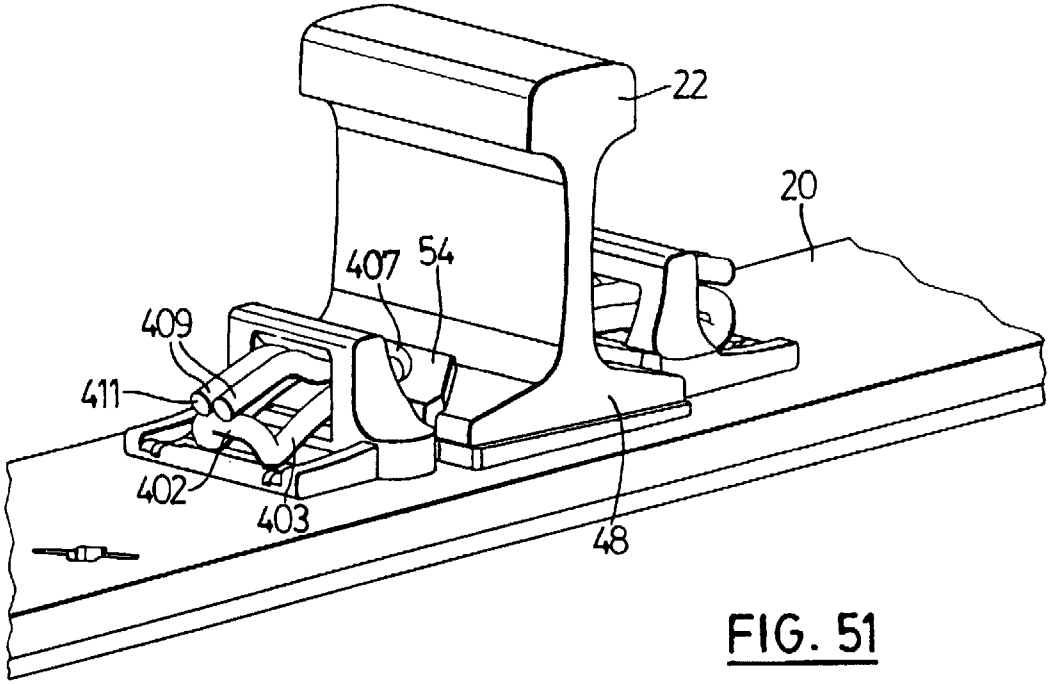
Figure 52:
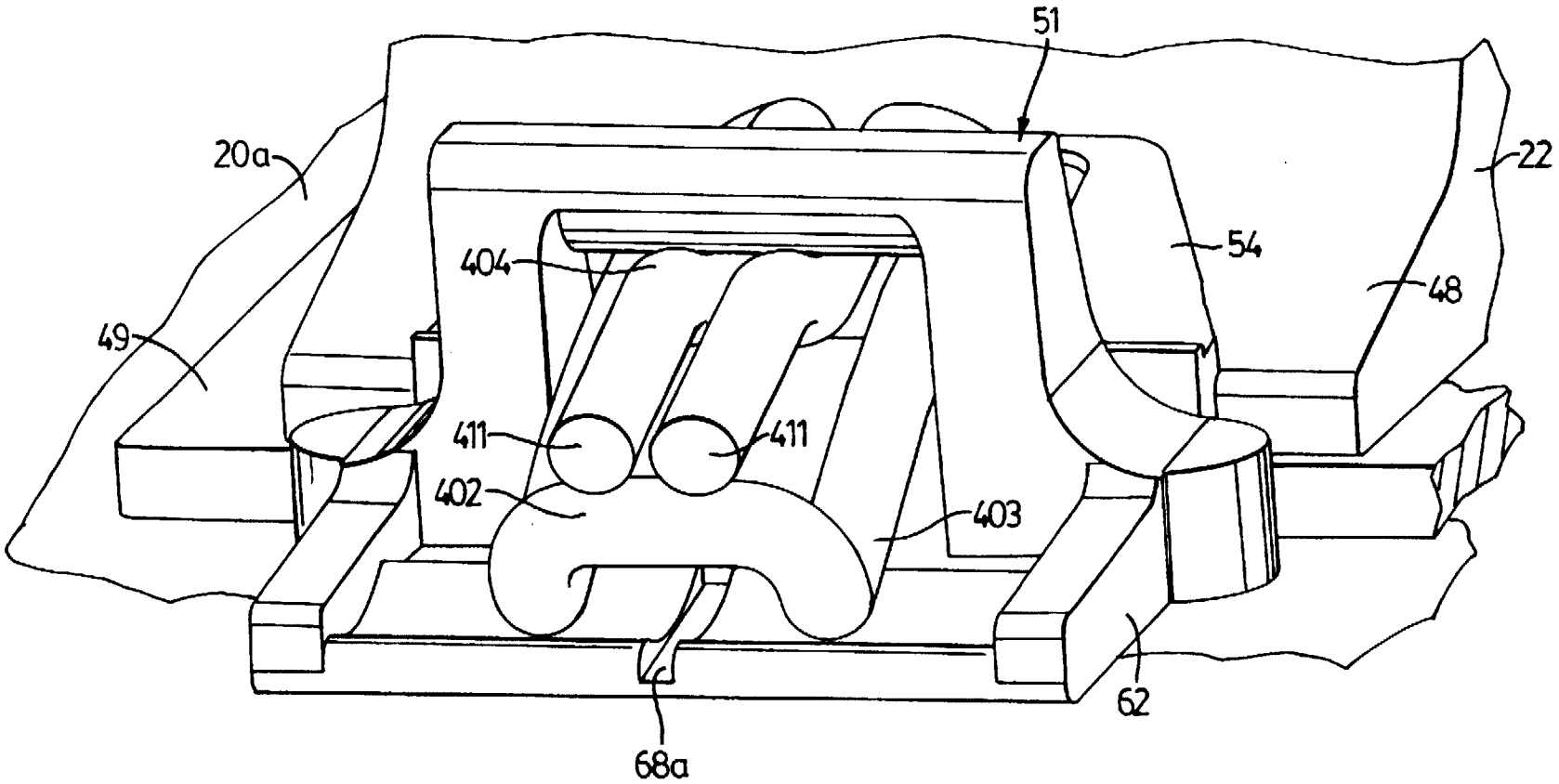
FIG. 52 is a rear view, and an enlarged scale of the fastening end clip of FIG. 51.
Figure 53:
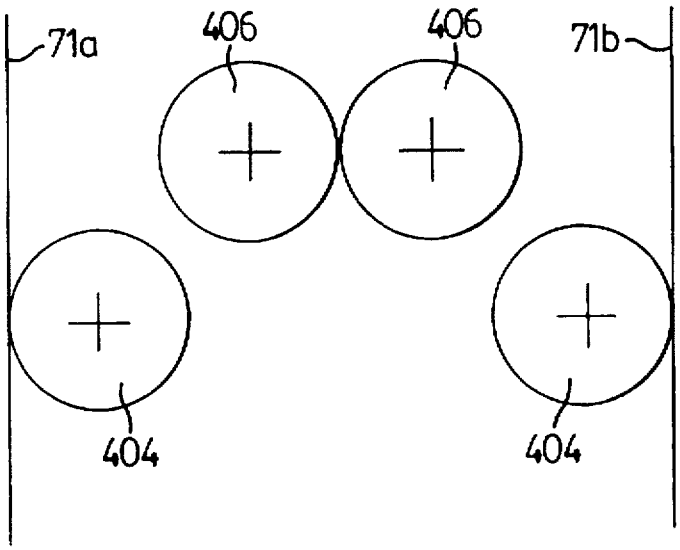
FIGS. 53 and 54 are cross-sections taken at the position shown by line LIII—LIII in FIG. 50, showing the configuration of the limb portions in the installed position, and at maximum rail rotation, respectively.

The rail clip 401, which may be formed of relatively thin gauge bent metal rod is again symmetrical about a vertical plane transverse to the rail 22 and comprises an outer central portion 402 that bridges longitudinal between outer lower limb portions 403. A lower pair of intermediate limb portions 404 extend arcuately upwardly from the portions 403. A pair of upper limb portions 406 extend generally parallel to the lower portions 404 and connect to them through a sharply arcuately upwardly extending transition 407. The upper limb portions 406 are spaced apart longitudinally a smaller distance than the lower portions 404, and may touch, as seen in FIG. 53. The upper limb portions 406 sweep outwardly upwardly through a transition portion 408 which in service contacts the abutment surface 77 and extend outwardly to upper limb portions 409 the ends of which 411 in an unstressed position as seen in FIGS. 50 to 52 are spaced a short distance above the longitudinal portion 402.

The spacing of the lower limb portions 404 is such that when the clip 401 is installed, the outer sides of the portions 404 engage snugly against opposing side faces 71*a* and 71*b* of the opening 71, as seen in FIGS. 11 to 14, 53 and 54. In the installed position, as seen in FIG. 53, the upper limb portions 406 are displaced slightly downwardly toward the lower limb portions 404 as compared with the as-manufactured condition, whereby there is a resilient downward reaction at the inner portion 407 bearing downwardly on the rail flange 48.

Figure 54:
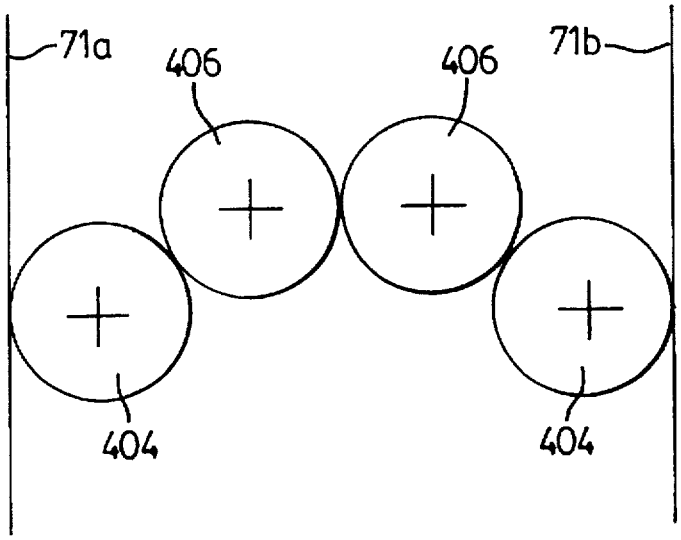

The clips 401 effectively serve to guard against uplift of the flange 48 or rollover of the rail 22. Upward pressure on the inner portions 407 of the lower limb portions 404 result in a greatly increased downward reaction between the abutment surface 77 and the upper limb portions 406, so that these are displaced downwardly into contact with the lower limb portions 404, as seen in FIG. 54 thus providing in effect a beam of greatly increased depth, strength and stiffness as compared with the individual rod components of the clip 401. Any reaction tending to cause spreading of the limb portions 404 is resisted by the side walls 71*a* and 71*b*. As a result, there is greatly increased reaction on the flange 48 at and beyond the state illustrated in FIG. 54.

Further, the toe or inner end portions 407 of the limb portions inwardly of the shoulder 51 spread apart and engage on the side walls 71*a* and 71*b* of the shoulder and resist any tendency for outward movement of the clip 401 relative to the shoulder 51.

Further, with the embodiment shown in the drawings, upward rotation of the rail flange 48 is resisted by the upper limb portions 409 being displaced downwardly into contact with the bridging portion 402 to provide increased stiffness.

It will be appreciated from consideration of, for example FIG. 50, the clips 401 may be relatively easily installed, as with the other clips described above, by insertion of the inner end portion 407 within the opening 77 somewhat loosely, and applying pressure to the outer end portions 402 and 411 to drive the clips inwardly to the installed position seen in FIGS. 50 to 52 wherein the lower portion 403 lodges in the pit 63, the clip is compressed between surfaces 77 and 63 and there is a downward toe load exerted by the inner portion of the clip, for example portions 407 on the rail flange 48.

FIG. 52 shows a somewhat modified version of the shoulder portion 51 provided with a central drainage channel 68*a*.

I claim:

1. A steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement; wherein said tie includes at least one ballast engaging plate member connected to the tie on its underside and facing generally transversely of the rail for restraining lateral tie movement; and where said least one ballast engaging plate member is curved to provide a concavity on a side facing transversely of the rail.

2. A tie according to claim 1 having said ballast engaging plate member adjacent each end of the tie.

3. A tie according to claim 1 wherein each said ballast engaging plate member has at least one upper end portion passing through an opening in the horizontal plate member.

4. A tie according to claim 3 wherein the upper end portion is adapted to resist withdrawal from said opening.

5. A tie according to claim 1 wherein the said web member extends through a slot in an upper side of each said ballast engaging plate member.

6. A tie according to claim 5 wherein a lower edge of said web member is notched adjacent each said ballast engaging plate member and a portion of each said ballast engaging plate member adjacent the lower end of the slot lodges in the notch.

7. A tie according to claim 1 wherein said web member has a bulbous lower edge.

8. A tie according to claim 1 wherein each longer side of the plate member has an outer margin portion inclined downwardly outward relative to the horizontal.

9. A tie according to claim 1 in combination with means for fastening a rail relative to the horizontal plate member comprising two hook-in shoulder members for bearing on opposite sides of the rail flange respectively, and each shoulder member having a pair of hook-in legs portion for passing through corresponding apertures in the horizontal plate member of the tie and for engaging with the lower side of the horizontal plate member.

10. A tie according to claim 9 wherein each hook-in leg has a laterally extending portion for engaging the lower side of the horizontal plate member.

11. A tie according to claim 9 wherein including a seat plate disposed on the horizontal plate member and receiving the rail thereon, and located by the engagement with the hook-in shoulder members.

12. A tie according to claim 11 wherein said seat plate has a tab portion at each side received in a complimentary recess in each shoulder member.

13. A tie according to claim 11 wherein the seat plate has a canted upper face.

14. A tie according to claim 9 wherein each shoulder member has an abutment portion upstanding therefrom having an opening therethrough providing a downwardly facing abutment surface for reaction with a rail clip.

15. A tie as claimed in claim 14 wherein said abutment portion is box-form and said opening therethrough is bounded by a continuous upper wall providing said downwardly facing abutment surface.

16. A tie as claimed in claim 15 wherein a lower side of said opening comprises an upwardly laterally inwardly inclining ramp portion.

17. A tie as claimed in claim 14 wherein each shoulder member has a seating portion extending laterally outwardly from the abutment portion and having a lower side bearing on the plate member and an upper side formed with a pit for locating a rail clip.

18. A tie as claimed in claim 14 wherein, for engaging a canted rail flange, the shoulder members on opposite sides having openings at different heights and said hook-in legs on one shoulder member of said pair having a different spacing from the legs of the other member of said pair, whereby the shoulder members on opposite sides of the rail flange are rendered non-interchangeable.

19. A steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement, wherein said tie includes at least one ballast engaging plate member connected to the tie on its underside and facing generally transversely of the rail for restraining lateral tie movement, and wherein each said ballast engaging plate member has at least one upper end portion passing through an opening in the horizontal plate member.

20. A tie according to claim 19 having said ballast engaging plate member adjacent each end of the tie.

21. A tie according to claim 19 wherein the upper end portion is adapted to resist withdrawal from said opening.

22. A tie according to claim 19 wherein the said web member extends through a slot in an upper side of each said ballast engaging plate member.

23. A tie according to claim 22 wherein a lower edge of said web member is notched adjacent each said ballast engaging plate member and a portion of each said ballast engaging plate member adjacent the lower end of the slot lodges in the notch.

24. A steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement, wherein said tie includes at least one ballast engaging plate member connected to the tie on its underside and facing generally transversely of the rail for restraining lateral tie movement, and where said web member extends through a slot in an upper side of each said ballast engaging plate member.

25. A tie according to claim 24 wherein a lower edge of said web member is notched adjacent each said ballast engaging plate member and a portion of each said ballast engaging plate member adjacent the lower end of the slot lodges in the notch.

26. In combination: a steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement; and means for fastening a rail relative to the horizontal plate member comprising two hook-in shoulder members for bearing on opposite sides of the rail flange respectively, and each shoulder member having at least one hook-in leg for passing through corresponding apertures in the horizontal plate member of the tie and for engaging with the lower side of the horizontal plate member.

27. The combination according to claim 26 wherein each hook-in leg has a laterally extending portion for engaging the lower side of the horizontal plate member.

28. The combination according to claim 26 wherein including a seat plate disposed on the horizontal plate member and receiving the rail thereon, and located by the engagement with the hook-in shoulder members.

29. The combination according to claim 28 wherein said seat plate has a tab portion at each side received in a complimentary recess in each shoulder member.

30. The combination according to claim 28 wherein the seat plate has a canted upper face.

31. The combination according to claim 26 wherein each shoulder member has an abutment portion upstanding therefrom having an opening therethrough providing a downwardly facing abutment surface for reaction with a rail clip.

32. The combination as claimed in claim 31 wherein said abutment portion is box-form and said opening therethrough is bounded by a continuous upper wall providing said downwardly facing abutment surface.

33. The combination as claimed in claim 32 wherein a lower side of said opening comprises an upwardly laterally inwardly inclining ramp portion.

34. The combination as claimed in claim 31 wherein each shoulder member has a seating portion extending laterally outwardly from the abutment portion and having a lower side bearing on the plate member and an upper side formed with a pit for locating a rail clip.

35. The combination as claimed in claim 31 wherein, for engaging a canted rail flange, the shoulder members on opposite sides having openings at different heights and said hook-in legs on one shoulder member of said pair having a different spacing from the legs of the other member of said pair, whereby the shoulder members on opposite sides of the rail flange are rendered non-interchangeable.

36. A steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement; wherein said tie includes at least one separately formed ballast engaging plate member connected to the tie on its underside and facing generally transversely of the rail for restraining lateral tie movement; and wherein said at least one ballast engaging plate member is detachably connected to said tie.

37. A tie according to claim 36 having said at least one ballast engaging plate member adjacent each end of the tie.

38. A tie according to claim 36 wherein said at least one ballast engaging plate member is curved to provide a concavity on a side facing transversely of the rail.

39. A tie according to claim 36 wherein each said ballast engaging plate member has at least one upper end portion passing through an opening in the horizontal plate member.

40. A tie according to claim 39 wherein the upper end portion is adapted to resist withdrawal from said opening.

41. A tie according to claim 36 wherein the said web member extends through a slot in an upper side of each said ballast engaging plate member.

42. A tie according to claim 41 wherein a lower edge of said web member is notched adjacent each said ballast engaging plate member and a portion of each said ballast engaging plate member adjacent a lower end of the slot lodges in the notch.

43. A steel tie for incorporation in a rail track, comprising a generally horizontal oblong rectangular plate member for connection transversely of the rail and for restraining vertical rail movement, said oblong plate member having two shorter and two longer sides, and a web member extending generally vertically on the underside of the plate member and generally parallel to and spaced inwardly substantially centrally of said longer sides of the plate member and serving to restrain longitudinal rail movement said web member having a lower edge portion of increased thickness as compared with an upper portion of the web for carrying tensile and compressive stresses arising from bending of the tie.

44. A tie according to claim 43 wherein said lower edge portion of the web member comprises a bulbous lower edge.

* * * * *